US007980631B2

(12) United States Patent
Diffrient

(10) Patent No.: US 7,980,631 B2
(45) Date of Patent: Jul. 19, 2011

(54) ERGONOMIC ARMREST

(75) Inventor: Niels Diffrient, Ridgefield, CT (US)

(73) Assignee: Humanscale Corporation, New York, NY (US)

( * ) Notice: Subject to any disclaimer, the term of this patent is extended or adjusted under 35 U.S.C. 154(b) by 0 days.

(21) Appl. No.: 12/330,598

(22) Filed: Dec. 9, 2008

(65) Prior Publication Data

US 2009/0091174 A1 Apr. 9, 2009

Related U.S. Application Data

(63) Continuation of application No. 10/693,154, filed on Oct. 23, 2003, now Pat. No. 7,475,946, which is a continuation of application No. 10/155,331, filed on May 24, 2002, now Pat. No. 6,959,965, which is a continuation of application No. 09/326,176, filed on Jun. 4, 1999, now Pat. No. 6,709,058, and a continuation-in-part of application No. 29/103,159, filed on Apr. 9, 1999, now Pat. No. Des. 453,633, and a continuation-in-part of application No. 29/103,158, filed on Apr. 9, 1999, now abandoned, which is a continuation-in-part of application No. 29/103,157, filed on Apr. 9, 1999, now Pat. No. Des. 435,746.

(51) Int. Cl.
*A47C 7/54* (2006.01)

(52) U.S. Cl. ..... 297/411.33; 297/115

(58) Field of Classification Search ..... 297/411.32, 297/411.33, 115

See application file for complete search history.

(56) References Cited

U.S. PATENT DOCUMENTS

| | | | |
|---|---|---|---|
| 413,156 | A | 10/1889 | Wilkerson |
| 518,097 | A | 4/1894 | Derby |
| 662,387 | A | 11/1900 | Baker |
| 691,854 | A | 1/1902 | Greer et al. |
| 2,456,797 | A | 12/1948 | Sheldrick |
| 2,497,395 | A | 2/1950 | Cramer, Sr. |
| 2,838,095 | A | 6/1958 | Deaton |
| 2,859,799 | A | 11/1958 | Moore |
| 2,859,801 | A | 11/1958 | Moore |
| D201,961 | S | 8/1965 | Lohn |
| D202,425 | S | 9/1965 | Stanley |
| D207,903 | S | 6/1967 | Belk |
| 3,333,811 | A | 8/1967 | Matthews |
| 3,337,267 | A | 8/1967 | Rogers, Jr. |

(Continued)

FOREIGN PATENT DOCUMENTS

WO 98/32353 7/1998

OTHER PUBLICATIONS

Taiwanese Publication No. 257955 "Inclinable construction for seat back" published on Sep. 21, 1995.

*Primary Examiner* — Anthony D Barfield

(74) *Attorney, Agent, or Firm* — Jones, Walker, Waechter, Poitevent, Carrere & Denegre, L.L.P.

(57) ABSTRACT

Disclosed is an adjustable armrest that can readily raised, or lowered, and optionally rotated in a horizontal plane. In one embodiment, the present armrest is released from its use position be raising the front portion of the armrest. The armrest is moved into the desired position and then the front portion is lowered to secure the armrest in the desired position.

9 Claims, 28 Drawing Sheets

U.S. PATENT DOCUMENTS 3,371,961 A 3/1968 Colgan
3,399,906 A 9/1968 Portnoff
3,477,761 A 11/1969 Krantz
D227,829 S 7/1973 Klose
3,947,069 A 3/1976 Lusch
4,003,599 A 1/1977 Takamatsu
4,030,781 A 6/1977 Howard
4,097,088 A 6/1978 Meiller
4,165,901 A 8/1979 Swenson et al.
4,244,623 A 1/1981 Hall et al.
4,270,798 A 6/1981 Harder
4,307,913 A 12/1981 Spiegelhoff
4,408,800 A 10/1983 Knapp
4,411,469 A 10/1983 Drabert et al.
4,429,917 A 2/1984 Diffrient
4,478,454 A 10/1984 Faiks
4,479,679 A 10/1984 Fries et al.
4,496,190 A * 1/1985 Barley ..... 297/411.32 X
4,685,730 A 8/1987 Linguanotto
4,732,424 A 3/1988 Uredat-Neuhoff
4,761,033 A 8/1988 Lanuzzi et al.
4,796,952 A 1/1989 Piretti
4,943,114 A 7/1990 Piretti
4,988,145 A 1/1991 Engel
5,080,318 A 1/1992 Takamatsu et al.
5,211,696 A 5/1993 Lacy
5,215,282 A 6/1993 Bonutti
5,251,958 A 10/1993 Roericht et al.
5,261,723 A 11/1993 Hosoe
5,292,097 A 3/1994 Russell
5,316,372 A 5/1994 Amner
5,356,201 A 10/1994 Olson
5,364,166 A 11/1994 Zegeer
5,383,712 A 1/1995 Perry
5,398,996 A 3/1995 Steiner
D357,834 S 5/1995 Nordstrom et al.
5,484,187 A 1/1996 Doerner et al.
5,486,035 A 1/1996 Koepke et al.
5,547,253 A 8/1996 Schwartz et al.
D394,756 S 6/1998 Gryp et al.
D398,793 S 9/1998 Maree et al.
D401,455 S 11/1998 Pate
D411,377 S 6/1999 Sacco et al.
6,003,947 A 12/1999 Rye
6,053,578 A 4/2000 van Hekken et al.
6,076,892 A 6/2000 van Hekken et al.
D436,260 S 1/2001 Nagamitsu
D451,294 S 12/2001 Simons et al.
D480,571 S 10/2003 Yu
6,755,472 B2 6/2004 Stenzel et al.
D507,122 S 7/2005 Beermann
D507,910 S 8/2005 Bock
D510,667 S 10/2005 Yamazaki et al.
D534,005 S 12/2006 Beermann
D555,922 S 11/2007 Esaki et al.
D564,807 S 3/2008 Da Re
D576,413 S 9/2008 Arnaout

* cited by examiner

ERGONOMIC ARMREST

This application is a continuation of prior application Ser. No. 10/693,154, filed on Oct. 23, 2003; now U.S. Pat. No. 7,475,946 which is a continuation of application Ser. No. 10/155,331 filed May 24, 2002, now U.S. Pat. No. 6,959,965 issued on Nov. 1, 2005; application Ser. No. 10/155,331 is a continuation of application Ser. No. 09/326,176 filed Jun. 4, 1999, now U.S. Pat. No. 6,709,058 issued on Mar. 23, 2004; application Ser. No. 09/326,176 is a continuation-in-part of application Ser. No. 29/103,157 filed on Apr. 9, 1999, now patent D435,746 issued on Jan. 2, 2001, and is a continuation-in-part of application Ser. No. 29/103,158 filed on Apr. 9, 1999, now abandoned, and is a continuation-in-part of application Ser. No. 29/103,159 filed on Apr. 9, 1999, now patent D453,633 issued on Feb. 19, 2002, each of which is hereby incorporated by reference as showing embodiments of my inventions.

BACKGROUND OF THE INVENTION

1. Field of the Invention

This invention generally relates to a device for supporting a user in a seated position, and in one preferred embodiment, to a chair of the reclining back type. In another preferred embodiment, this invention relates to a chair having automatically adjusting armrests. In a further preferred embodiment, this invention relates to a chair having an adjustable headrest. In a still further preferred embodiment, this invention relates to a chair having an automatically adjusting resistance to tilting that increases in proportion to the weight of the user and as the tilt angle is increased. In a yet further preferred embodiment, the chair has a tilting mechanism which changes the angle of the seat and its support and increases the chair's angle of maximum recline, as well as providing a forward tilting position.

2. Description of the Related Art

Reclining type chairs commonly used in offices usually provide for the back to recline alone, for the seat and back to recline as a unit, or the seat back may recline in a coordinated proportion with the seat. If the back alone pivots, it generally creates a problem known as "shirt tail pull." This problem is particularly acute if the pivot of the chair back is not coordinated with the natural body action. This problem can also be accentuated by the tendency of the hips of the user to slide forward as the back tilts rearwardly.

In chairs where both the seat and back recline as a unit, in the reclined position there is a tendency to lift the legs of the user from the floor creating an undue pressure by the forward edge of the seat against the underside of the legs of the user immediately above the knee. To overcome this problem the pivot point of the reclining action may be moved forward sufficiently to permit the user's feet to stay on the floor. The undesirable effect of this arrangement is that the body angle between the user's torso and legs is unchanged and as a result, the user's eye level drops undesirably when the chair is reclined.

In any reclining chair, it is desirable that the recline pivot point be at the center of the body or where the user's back normally pivots (i.e., an axis through the user's hip joints). The pivot point of a reclining chair is normally displaced from the ideal pivot point. It is also desirable to have a chair wherein the angle between the user's torso and his legs opens up to relieve internal congestive body pressures. It is, of course, also desirable to provide a chair wherein the user's feet remain on the floor and the recline action parallels the natural body action closely enough to avoid the common shirt tail pull problem.

It is also desirable to provide a chair which is of simplified construction and yet of clean, pleasing appearance emphasizing the isolated and separate appearance of the seat and back with respect to the supporting frames.

My earlier U.S. Pat. No. 4,429,917 shows one approach to solving these problems. U.S. Pat. No. 4,943,114 to Piretti allegedly reports a chair with a compact backrest linkage mechanism that enables the chair backrest and seat to recline.

U.S. Pat. No. 5,251,958 to Roericht, et al., allegedly reports a chair with a synchronous adjusting device that uses the weight of the user to provide a restoring force to return the chair back to an upright position after a user has reclined in the chair.

U.S. Pat. No. 5,486,035 to Koepke, et al., asserts, without providing any showing, that "In such constructions, the difficulty of reclining the chair, i.e., generating the reclining force, increases the further the chair is reclined, and it is common to employ adjusting apparatus for increasing or decreasing the reclining tension of a chair, such adjusting apparatus changing the tension of a spring, or otherwise modifying the reclining mechanism." Col. 1, 1. 29-34.

While chairs with arms are well known in the art, heretofore, the arms have been either fixed, or adjustable. If the arms were adjustable, any adjustments have been less than ideal and/or quite cumbersome.

Additionally, it was known in the art to put a headrest on a chair, including a reclinable chair. However, such headrests typically provided the chair occupant with very little support, i.e., when the chair is reclined, the headrest maintains its position relative to the back of the chair. Alternatively, if the headrest were to provide the chair occupant with substantial support, the headrest required awkward adjustments.

Moreover, while it is believed that some reclining chairs heretofore available have had a means to adjust their resistance to reclining, such adjustments have been less than ideal, and/or very cumbersome and not practicable.

Instead, rather than confront the processes necessary to adjust their chairs to fit the needs of their particular body build, most users of chairs use them without making any adjustments. Consequently, any ergometric advantages that might be delivered by the properly tuned chair are not achieved. Thus, there remains a need for a chair that is adjustable to the needs of the individual chair occupant without requiring any substantial effort on the occupant's part to effect the adjustments. In other words, a substantially self-adjusting ergometric chair.

OBJECTS OF THE INVENTION

It is an object of one embodiment of the present invention is to provide an occupant-weight-operated chair having a reclinable back wherein the chair is of a simple economical construction and lends itself to high production manufacturing and fabrication procedures.

A further object is the provision of a tilting chair wherein the frame supporting the seat and back are pivotally connected to the seat and fixedly connected to the back in a manner to emphasize the isolated and separate appearance of the seat and back. An alternative object is to provide armrests that are readily adjusted.

These and other objects and advantages of the invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

SUMMARY OF THE INVENTION

Among advantages, some embodiments of the present invention provide an occupant-weight-operated chair having a reclining back wherein the occupant's weight loads the chair mechanism and automatically adjusts the reclining tension or force to recline the chair back. In a further preferred version of such embodiments, this occupant-weight-operated chair provides a substantially uniform force opposing the reclining of the chair back throughout its range of movement. Moreover, while this mechanism includes a spring, it does not rely on a spring or other adjustment to increase or decrease the chair reclining force. Instead, the spring merely provides a secondary or auxiliary force to the force provided by the user's weight. The spring does not require any adjustment.

An occupant-weight-operated chair in accord with the inventive concepts includes a chair having a seat and a back mounted upon support structure, such as a caster-mounted pedestal. The back is reclinable with respect to the seat, and the structure of the chair, and the relationship of the components, is such that as the back is reclined the entire seat raises against the weight of the occupant. In this manner, the occupant's weight loads the chair mechanism, and the force required to recline the back is substantially uniform throughout the back-reclining range of movement, such force being regulated by the weight of the occupant upon the seat rear portion. In turn, through the connecting top links, lifts the entire seat a small amount, typically between about a quarter of an inch to an inch. Preferably, the seat is lifted by between about a half and three quarters of an inch.

Furthermore, the inventive occupant-weight-operated chair with a reclinable back attaches the back to the seat rear region so that reclining the back raises the elevation of the seat rear region against the occupant's weight. The combination of the upward movement of the chair seat in conjunction with the reclining rotation of the chair back simulates the movement of the user's torso about the user's hip joint as the user reclines.

Some other embodiments of the present invention provide a tilting chair wherein the back is theoretically pivoted relative to the seat at or in alignment with approximately the ideal pivot point of the body of a user (for reclining the back, the ideal pivot point corresponds to a horizontal axis through the user's hip joint). In addition, the seat lifting is coordinated with the back recline to simulate the natural action of the reclining body.

In another embodiment, the present invention provides a chair occupant with a headrest support that adjusts to provide the support when support is needed and to retract to an out of the way position when not needed.

In still further embodiments of the present invention provides a chair occupant with armrests that readily, and simply adjust to deliver support to the user through a greater range of useful positions than was available through the arm rests that have been heretofore available. Such support should be provided when and as needed by the chair occupant.

A yet still further embodiment of this invention provides a variable resistance to recline of the back as the adjustable mechanism is tilted forward or rearward. In the forward tilted mode there is less resistance to recline and more resistance in the rearward tilted mode. These changes are effected automatically without adjustment being required by the user.

Some preferred embodiments of a tilting chair of the present invention have a base that pivotally supports a seat with opposite links of a two four-bar linkage mechanisms. Typically, in such embodiments, one set of the opposite links on each side of the chair extends to support the back. Additionally reclining chair embodiments of the present invention usually have a base that forms a fixed bar of the linkage. This linkage translates the actuation of the rear links into a change in the angle of the forward links.

Some of the reclining chairs of the present invention have a spring in the base which acts on one of the bars of the linkage is operative to urge the chair to an upright position. This spring also provides some assistance to counterbalance the user's recline force.

Desirably, the chair lift mechanism of a reclining chair of the present invention is not normally noticed by the user, nor does such a chair lift the user's feet off of the floor.

With the present invention, a tilting chair is provided wherein the seat back pivot is effectively at the ideal point and which obviates the problems of shirt tail pull and feet lift common in prior art chairs. The present invention provides a chair in which both the seat and back are supported from the base by a linkage mechanism which permits the tilting of the back to increase the angle of the user's torso to his legs.

This reclining of the seat and back can be achieved with a four-bar linkage. The four-bar linkage can be parallel or non-parallel. In one embodiment of the inventive chair, the seat is supported on each side by one of the links or cranks of the four-bar linkage. The base of the chair forms a second link, or crank. The third link, or crank, extends to support the chair back. The fourth link couples the forward portion of the base to the forward portion of the seat. The linkage is duplicated on each side of the chair.

The pivots of the linkage are designed so that the body weight tends to balance the seat pivot and a spring within the base is operative on one of the bars of the linkage to urge the chair to an upright position, simply to overcome the weight of the chair and maintain an unoccupied chair in an upright position.

Typically, when the chair is reclined by a user, the spring adds a small amount of return force. However, as the body weight of the user determines the amount of force necessary to return the chair to the upright position, and thus this force will vary among users and the degree of recline, the chair of the present invention uses the body weight of the user to counter-act the user's recline.

The bars of the linkage on each side of the chair are pivotally connected to the seat and the extended bar is fixedly connected to the back in a manner to emphasize the isolated and separate appearance of the seat and back.

Typically, the base spaced below the seat is of relatively small clean and compact construction housing the lower journals for the above-noted third and fourth links. In addition, the base houses the spring and a vertical height adjustment mechanism.

The horizontal links above the base are rails on which the seat pan is supported within guide tracks so the seat may be slid back and forth to adjust seat depth. The position of the seat within the guide tracks is fixed by a conventional mechanism.

Preferably, the back and seat portions are formed of a molded, stiffly flexible and resilient, synthetic plastic material, such as a reinforced glass fiber or other high strength material capable of flexing. The seat includes an upper, underside, front, and rear portions. Likewise, the back has an upper, lower, front, and rear portions. The upper portion of the seat and the front portion of the back are typically contour molded and covered by a conventional cushioning material.

The underside of the seat front region (typically at the front of the rails that support the seat pan or support) is connected to the base by a pivot, and the underside of the seat rear portion is connected via a link to the lower region of the back.

As the seat reclines, and the rearward links (typically extensions of the back support) pivot about the rear pivot points on the chair base. As a result of the this pivoting, the pivot points under the seat support are raised slightly upwardly and rearwardly. The action of the seat support moving in this upward and rearward manner pulls the forward link (e.g., the upper horizontal seat support rails) so as to raise the forward portion of the seat. This lifting of the seat against the occupant's weight, accordingly, uses the occupant's weight to "load" the back to resist the reclining forces. As a result, a seat constructed in accordance with this aspect of the invention has a substantially uniform resistance to reclining due to the fact that it is the occupant's weight which produces such resistance. As the reclining tension is adjusted by the weight of the occupant, the greater the occupant's weight, the greater the force required to recline the seat back, and vice versa.

In some embodiments of the present invention, the chair has one or two adjustable armrests. The adjustable armrests are supported by a pair of rods the originate in the back of the chair. Preferably, the adjustable arm support rods originate from an "exoskeleton" that holds the back of the chair. While it is most preferred that the chair having the adjustable arms is the reclinable chair of this application, the adjustable arms of the present invention can be adapted to most any chair having a back.

In a particularly preferred embodiment, the arms are readily raised or lowered. To disengage an arm, and permit it to be repositioned, the distal end of the armrest is raised by a slight amount, say about a centimeter. Once the positioning mechanism is disengaged, the arm can be readily repositioned to any height. When positioned, the arm is released and it falls into place, re-engaging the positioning mechanism. In one embodiment of this adjustable arm invention, a chair has two arms that are independent of each other. In an alternative embodiment of the adjustable arm invention, the movement of one arm adjusts the second arm a corresponding amount in the same direction.

In a particularly preferred embodiment, the chair has a headrest that moves forward to support the chair occupant's head as the chair is reclined back and retracts as the chair returns to its upright resting position. In this manner, the chair occupant's head is supported when the support is most needed, i.e., during full recline when the occupant's head is not aligned with the occupant's back. However, when the support is not needed, i.e., in the upright position when the occupant's head is aligned with the occupant's back, the support is moved out of the way. It is preferred that the headrest moves on an arc that mimics the natural movement of the head.

While it is most preferred that the chair having the automatically adjusting headrest is the reclinable chair of this application, the automatically adjusting headrest of the present invention can be adapted to most any chair having a reclinable back.

In yet another particularly preferred embodiment, an alternate support mechanism may be used in the base or lower link position that allows the entire chair above the base to be tilted forward or to the rear and locked in any position, i.e., either extreme or at any position between these extremes. This alternate support mechanism provides forward tilt for seat and back for work positions, such as writing, and the rearward tilt provides additional recline to the backrest.

From time to time, the term "resting position" is used herein to refer to the upright or forward tilt position of the unoccupied chair.

DETAILED DESCRIPTION

Figure 34:
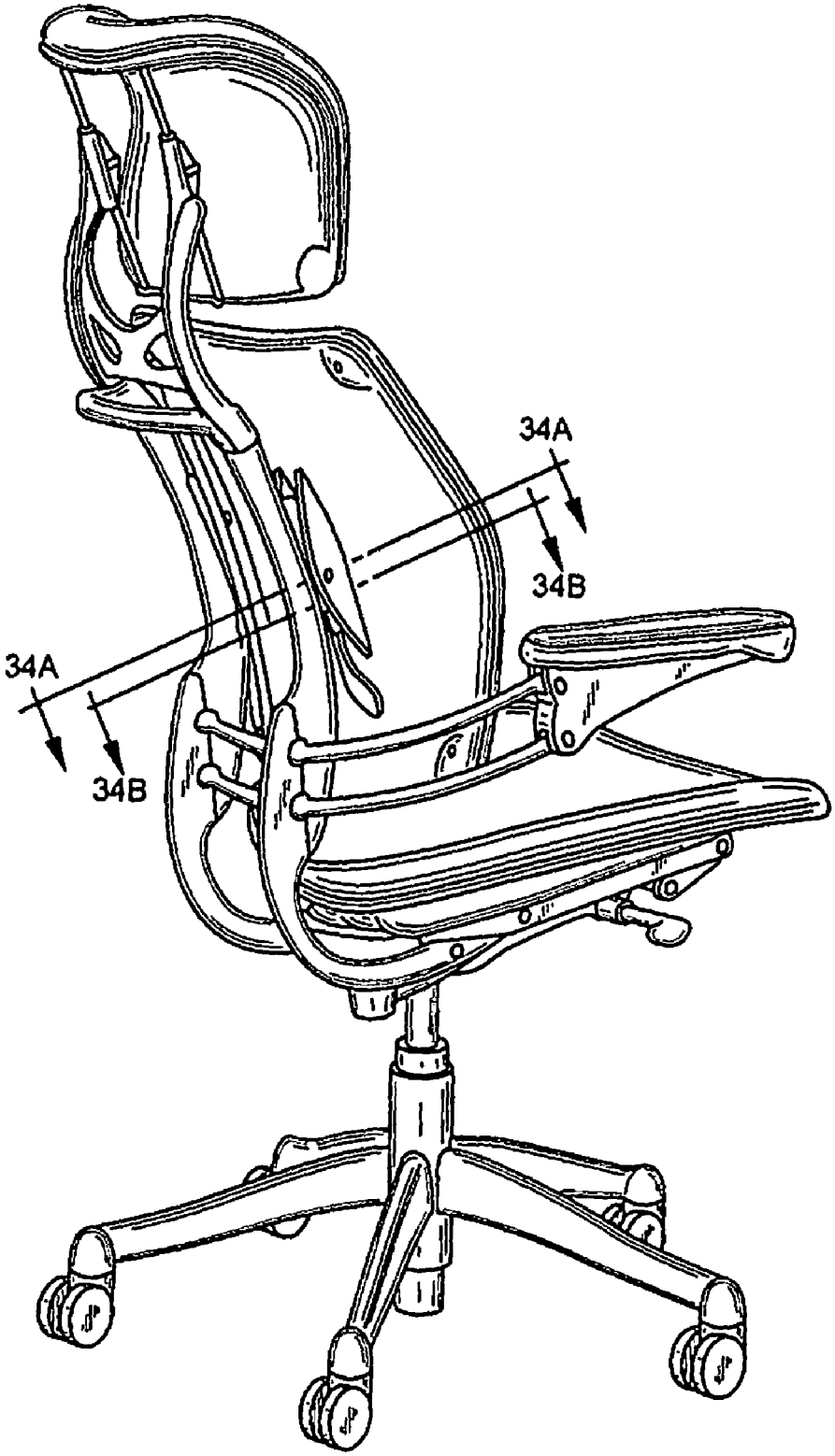
FIG. 34 is a side view of a preferred embodiment of the inventive chair incorporating the inventive armrest and the inventive headrest.
Figure 34A:
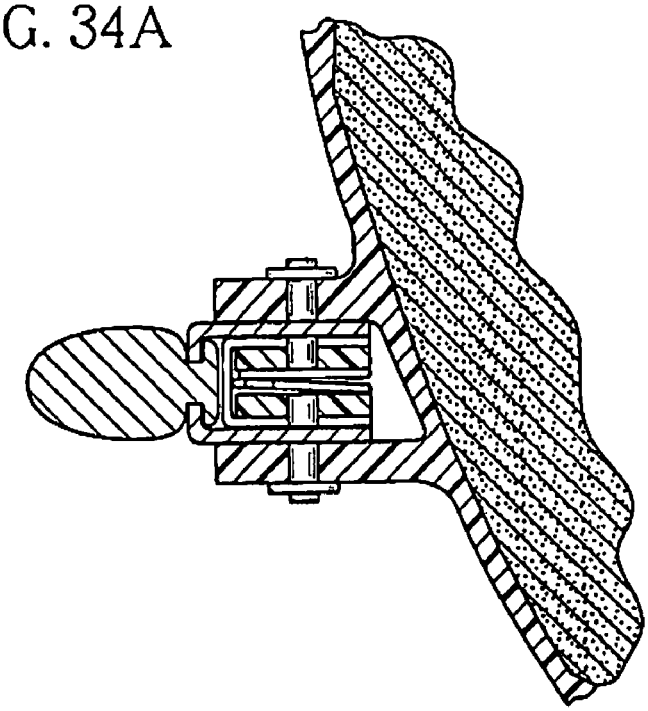
FIG. 34A is a sectional view of the back of the chair of FIG. 34 taken along line 34A-34A in FIG. 34.
Figure 34B:
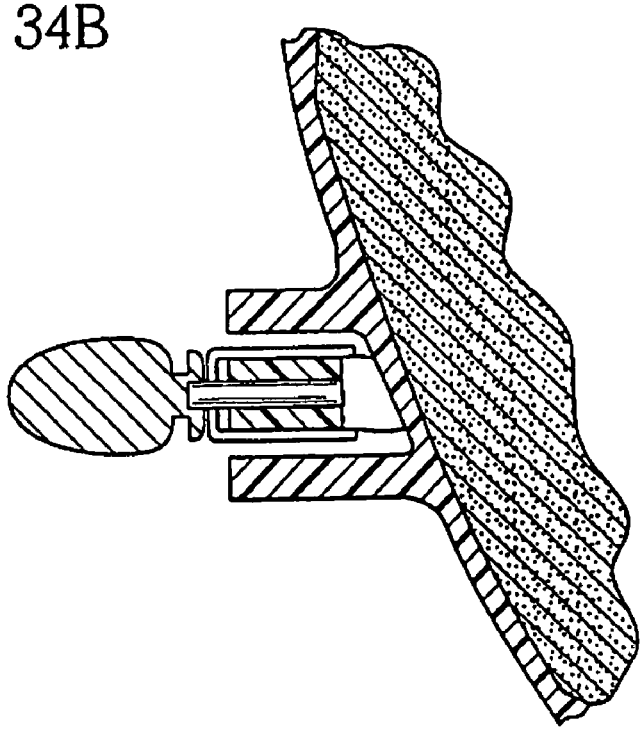
FIG. 34B is a sectional view of the back of the chair of FIG. 34 taken along line 34B-34B in FIG. 34.

The present invention comprises several developments that can be incorporated singly, or in any combination, into conventional chair designs. For example, the method and mechanism of the present invention for reclining the back of a chair can be used alone, or it could be used with the method and mechanism of the adjustable armrest, the method and mechanism of the adjustable headrest and/or the method and mechanism of the tilt mechanism. FIG. 34 illustrates a chair that incorporates several aspects of the present invention into a chair design specifically including the method and mechanism of the present invention for reclining the back of a chair, the method and mechanism of the adjustable armrest, the method and mechanism of the adjustable headrest and the method and mechanism of the tilt mechanism.

To understand how the present invention operates, the several separate inventive aspects are described separately. To start with, the method and mechanism for reclining the back of the seat in a way that uses the seat occupant's weight to counteract the reclining force is described. Thereafter, other inventive aspects of the inventive chair design are described.

Figure 1:
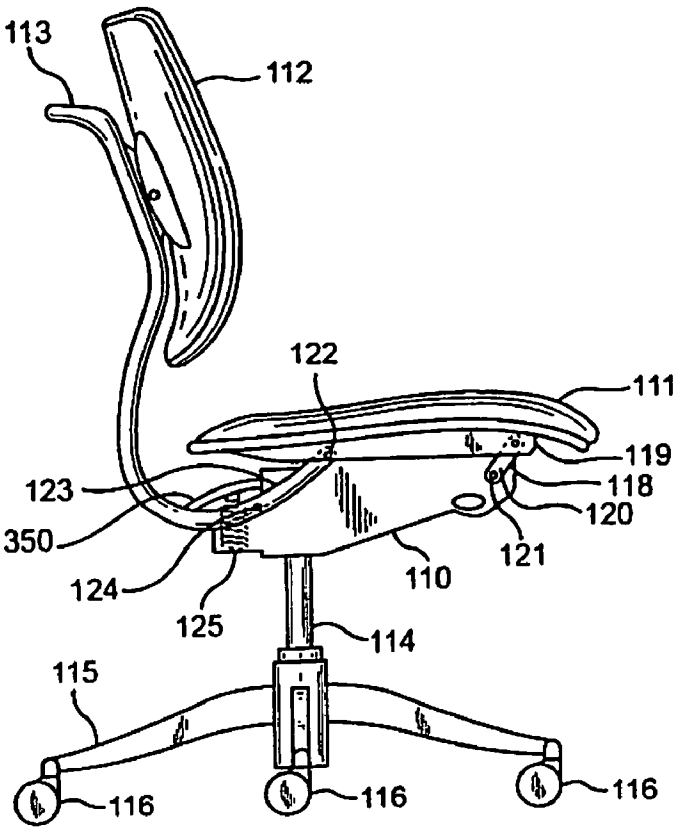
FIG. 1 is a side elevation of a reclining chair in accordance with the present invention illustrating the seat and back in upright position.

Referring first to FIG. 1, it will be seen that the chair comprises a base 110, a seat 111 which is secured to seat support 119 and a back support 113 which supports back 112. The base 110 is supported on pintle 114 projecting upwardly from the center of five-legged pedestal 115, the ends of the legs accommodating casters 116 supporting the chair on floor 117.

Seat 111 is supported by seat support 119, which in turn is connected to base 110 rearwardly by back support extension 123 and forwardly by support arm 120. Specifically, back support extension 123 is connected to base 110 by horizontal pivot point 124 and to seat support 119 by horizontal pivot point 122. Correspondingly, support arm 120 is connected to base 110 by horizontal pivot point 121 and to seat support 119 by horizontal pivot point 118. As a result, the combination of base 110, support arm 120, seat support 119, back support extension 123 and horizontal pivot points 118, 121, 122 and 124 form a substantially parallelogram linkage that permits movement between the forward and downward position in one direction (shown in FIG. 1) and the rearward and upward position of seat 111 in the other direction (shown in FIG. 2).

An imaginary horizontal extension of base 110 and support arm 120 forms a forward facing acute angle 101, which, when the chair is in its resting position, is of at least about 5°, preferably of at least about 10°, and most preferably of at least about 20°. Nonetheless, the forward facing acute angle 101, when the chair is in its resting position, is normally less than about 45° and preferably less than about 40°. A highly preferred forward facing acute angle 101, when the chair is in its resting position, is about 26°.

Correspondingly, base 110 and back support extension 123 form a forward facing acute angle 102 which is typically less than the forward facing acute angle 101. The forward facing acute angle 102, when the chair is in its resting position, is of at least about 5°, preferably of at least about 8°, and most preferably of at least about 15°. Nonetheless, the forward facing acute angle 102, when the chair is in its resting position, is normally less than about 40° and preferably less than about 30°. A highly preferred forward facing acute angle 102, when the chair is in its resting position, is about 18°.

It is preferred that the raising of seat 111 to counteract the reclining of back support 113 lifts seat 111 between about 0.2 and 2 inches. Its is further preferred that the seat is raised between about 0.4 and 1 inch. In a particularly useful embodiment of the present reclining chair invention, the seat is raised by about 0.6 inches in the front and by about 0.8 inches in the rear.

As is apparent from the above description, the pivot point for the recline of the back support 124 is not the chair occupant's hip joint. Consequently, the recline of the back circumscribes an arc that is displaced from the arc based on the user's hip joint. However, the concurrent action of the reclining mechanism described herein of raising the seat produces a net positioning of the user that is substantially the same as the positioning which would have been achieved if the center of the back recline arc were coextensive with the hip joint.

Figure 2:
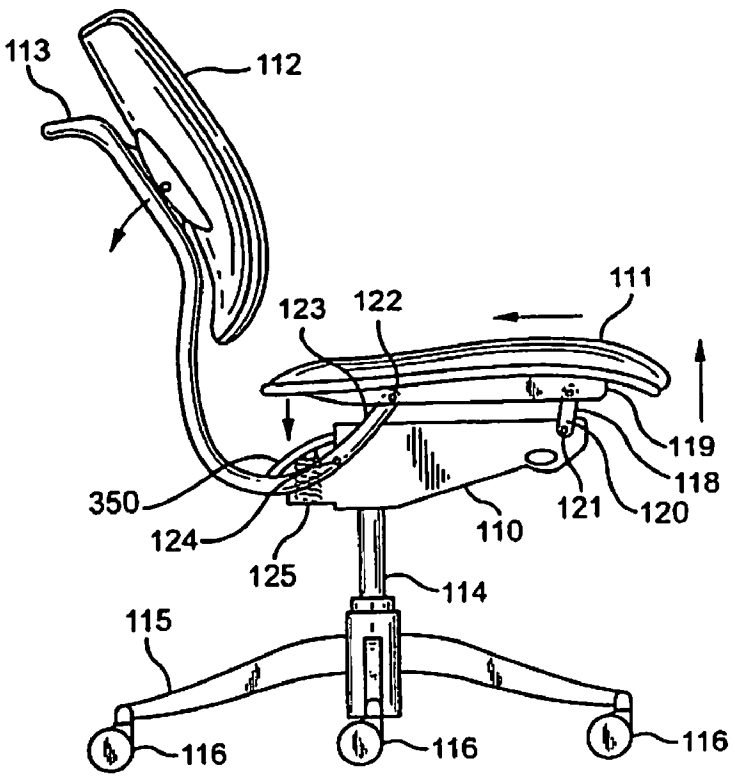
FIG. 2 is a side elevation of a reclining chair in accordance with the present invention illustrating the seat and back in tilted position.

FIGS. 1 and 2 also show spring means 125 which acts to restore back support 113 to its resting position when the chair is unoccupied.

Typically, both seat 111 and back 112 have a rigid shell, such as an injection molded plastic. It is preferred that seat 111 has a layer of a non-compressible, displacing gel. For example, a polyurethane gel is useful. Typically the gel pad on seat 111 is about half an inch thick and is located on top of a one inch thick layer of a conventional soft foam. It is further preferred that the seat 111 is shaped to reduce pressure points at the thickest portion of the gel.

Typically the back 112 has an about ¾ inch thick layer of a conventional soft foam attached to the rigid shell.

Figure 21:
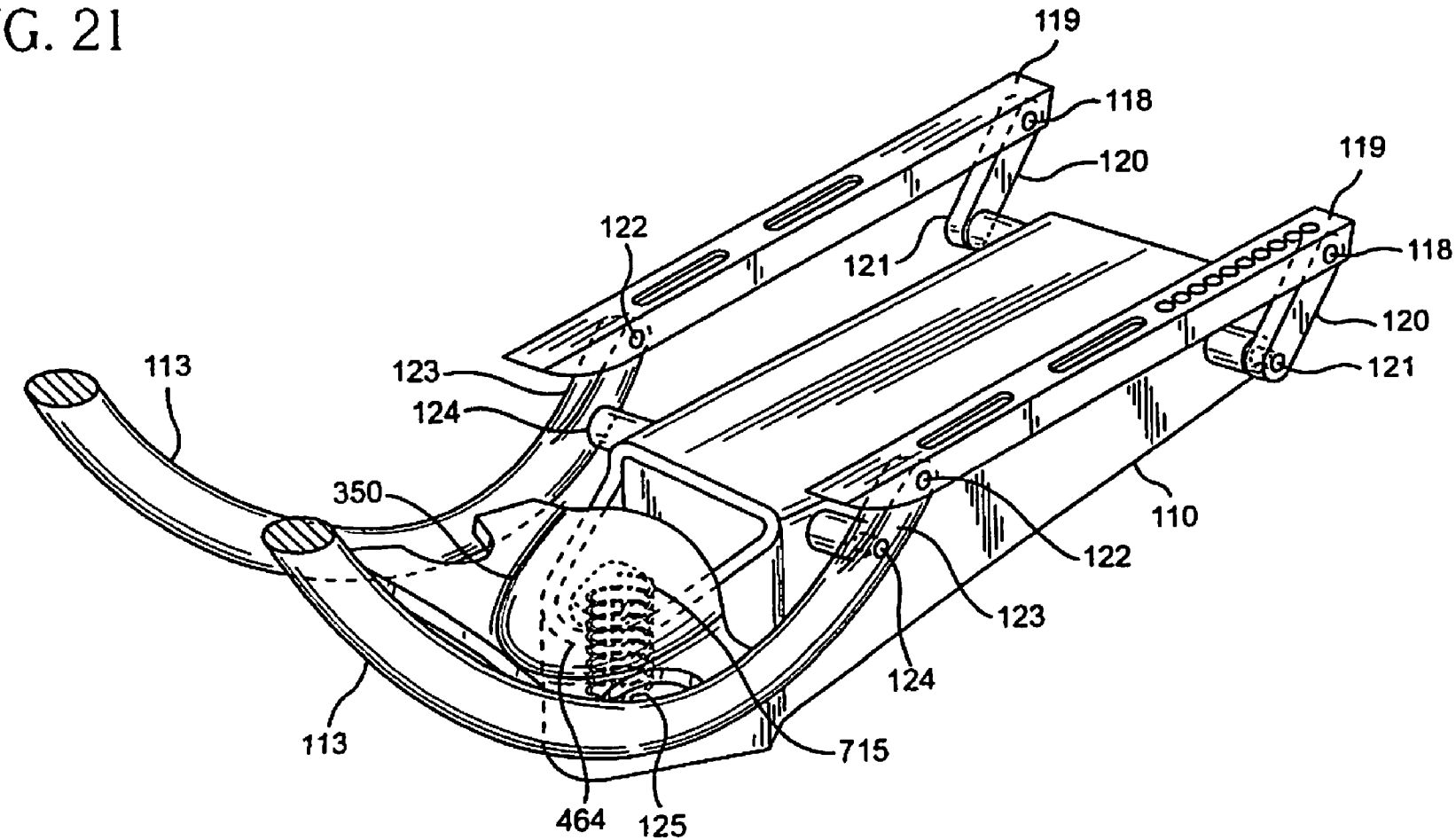
FIG. 21 shows a view of an embodiment of a mechanism according to the present invention for couplingly using the chair occupant's weight to counteract the reclining of the chair back in isolation.

FIG. 21 provides another view of the interaction of the parts of the mechanism that uses the chair occupant's weight to counteract the reclining forces to help return the chair back to its upright or resting position. Again, chair back 113 is pivotally linked to base 110 at pivot point 124. Chair back extension 123 continues and is pivotally linked to seat support 119 at pivot point 122. Similarly, the front of base 110 is linked to the front of seat support 119 by the operation of link 120 which is pivotally coupled to base 110 at pivot point 118 and it is pivotally connected to seat support 119 at pivot point 121.

FIG. 21 also shows spring 125 and telescoping spring guide 464 interacting through pillow block 715 with connecting element 350, which is attached to back support arms 113.

Also shown in FIG. 21 is a plurality of slots that permit the seat of the chair to be advanced forward or backward to alter the chair to better accommodate a user. In the embodiment shown in this figure, the slots anchor the seat in the appropriate position.

Figure 21A:
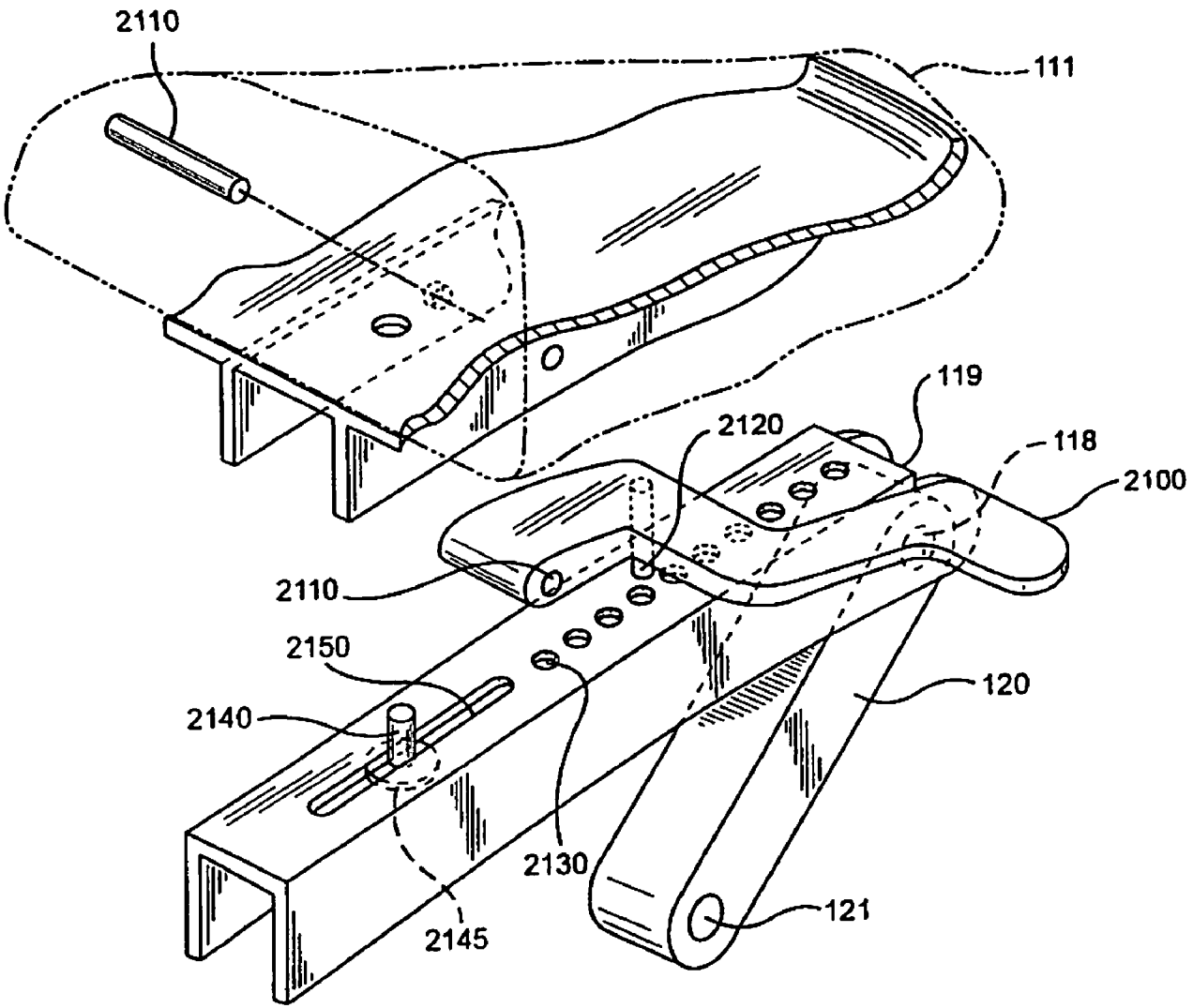
FIG. 21A shows an exploded view of a means for movably mounting a seat on the seat support in an embodiment of the present invention.

FIG. 21A shows a means to secure the movable seat in the desired position. In this embodiment, lifting lever 2100 causes lever 2100 to pivot about pivot joint 2110 and lift pin 2120 out of slot 2130. When pin 2120 is out of slot 2130, seat 111 can move along support 119, while being attached by pin 2140 that has an enlarged head 2145 below support 119. At its upper end, pin 2140 is attached to seat 111.

An alternative mechanism for interconnecting the seat occupant's weight to the force to restore the chair to its upright position replaces support arm 120 with a mechanism that performs the same function as the four-bar mechanism described above can be substituted for the four-bar mechanism. For instance, support arm 120 could be replaced by a track mounted on base 110 and a traveler projecting downward from seat support 119. When back support extension 123 is pivoted as back 112 is reclined, seat support 119 pulls the traveler up the track which is inclined in a backward direction. Desirably, the track or the traveler, or both, have a low friction surface such as polytetrafluoroethylene.

In the embodiments of the present invention having a headrest, it is preferred that the headrest has a layer of about one inch thick of a conventional soft foam.

Figure 7:
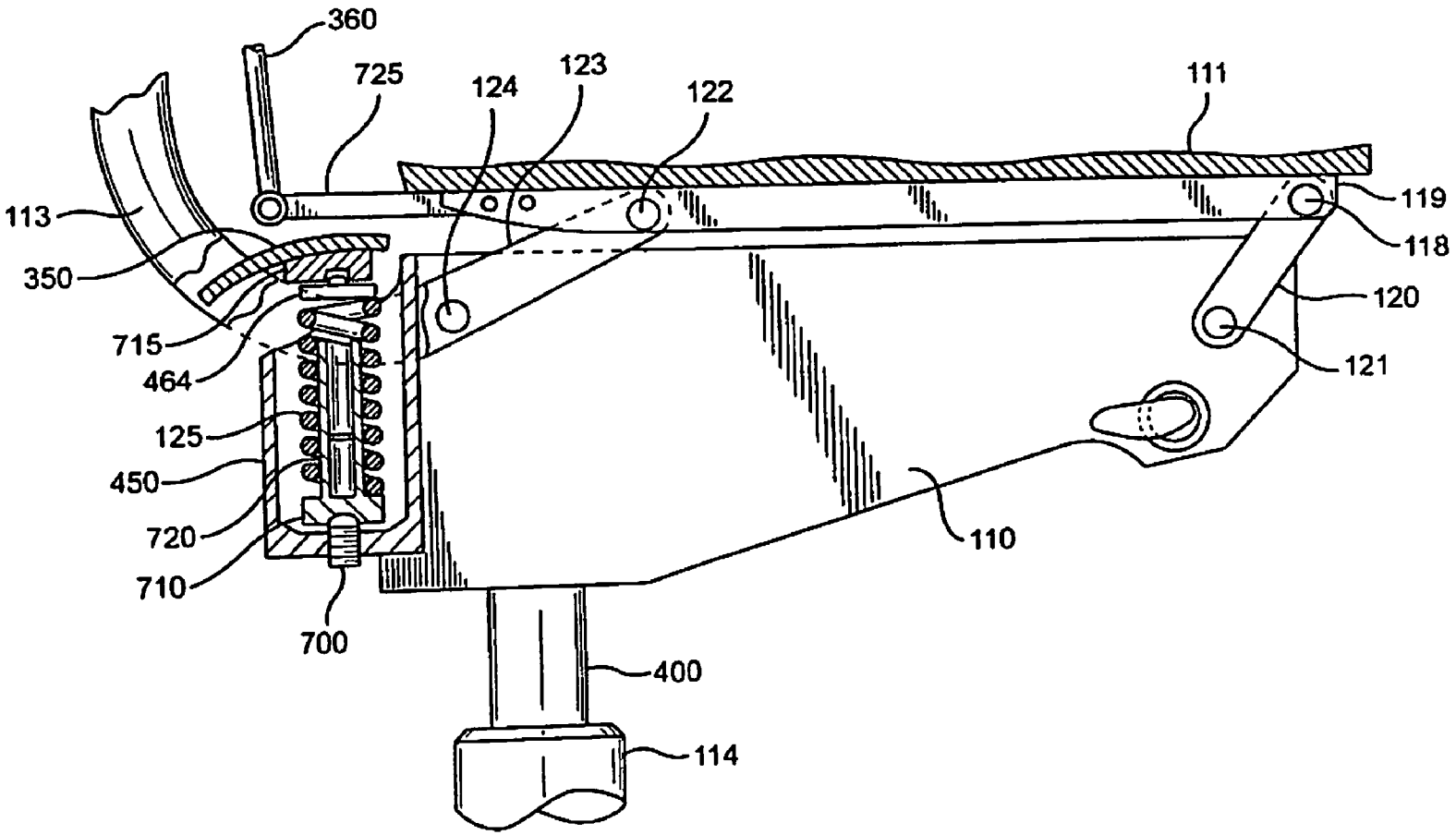
FIG. 7 is a side elevation view of a chair base useful with the chair of the present invention.

A first embodiment of base 110 of the present invention is illustrated in FIG. 7. As seen in this figure, base 110 is mounted on pintle 114 via piston 400. Piston 400 is part of a conventional gas cylinder for raising or lowering the height of the chair. Base 110 has a forward pivot axis 121 and a rearward pivot axis 124. In the reclining chair of the present invention, the pivot axes are connected to two links of the four-bar linkage that interconnects the reclining of the chair back with a raising of the seat. Base 110 also has a spring means 125 that applies a force to the chair so as to maintain the unoccupied chair in its upright position. Spring means 125 is mounted about cylinder 720, which in turn is mounted on cylinder base 710 which is attached, preferably pivotably attached, to attachment point 700 which is an integral portion of base 110.

Additionally, FIG. 7 also shows telescoping spring guide 464 (which is slidably mounted in spring cylinder 720). Pivotably seated on top of telescoping spring guide 464 is a top pillow block 715 which bears against connecting element 350 between back support arms 113.

Desirably, the top pillow block 715 is made of a low friction material such as polytetrafluoroethylene commonly marketed under the Tradename TEFLON.

Also shown in FIG. 7 is extension 725, attached to seat support or link 119, which in automatically adjusting headrest embodiments can form an attachment platform for the rod that translates the recline of the chair back into a forward motion of the headrest.

Figure 8:
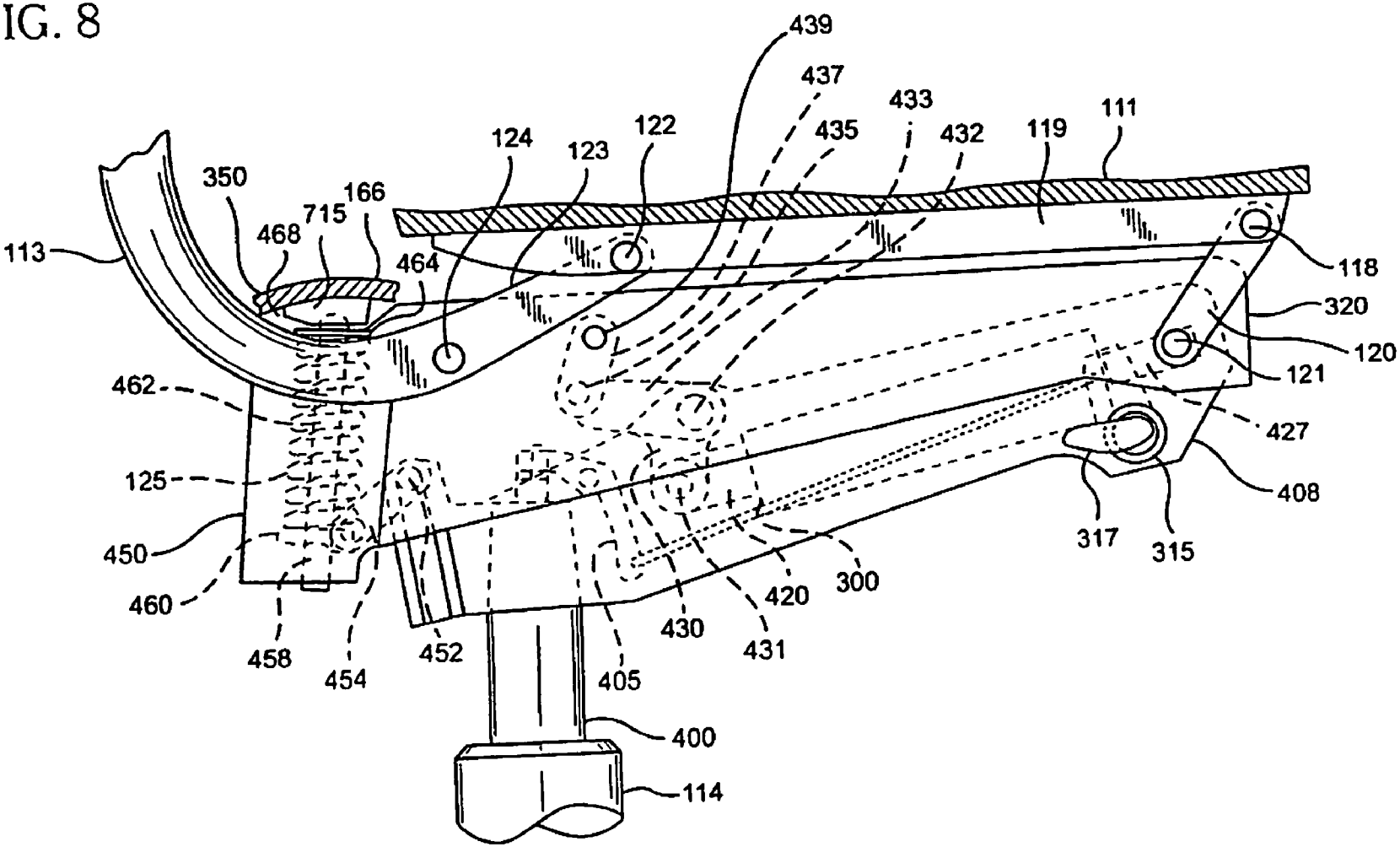
FIG. 8 is a side elevation view of a chair base capable of providing extra tilt to a chair of the present invention in the resting position.
Figure 8A:
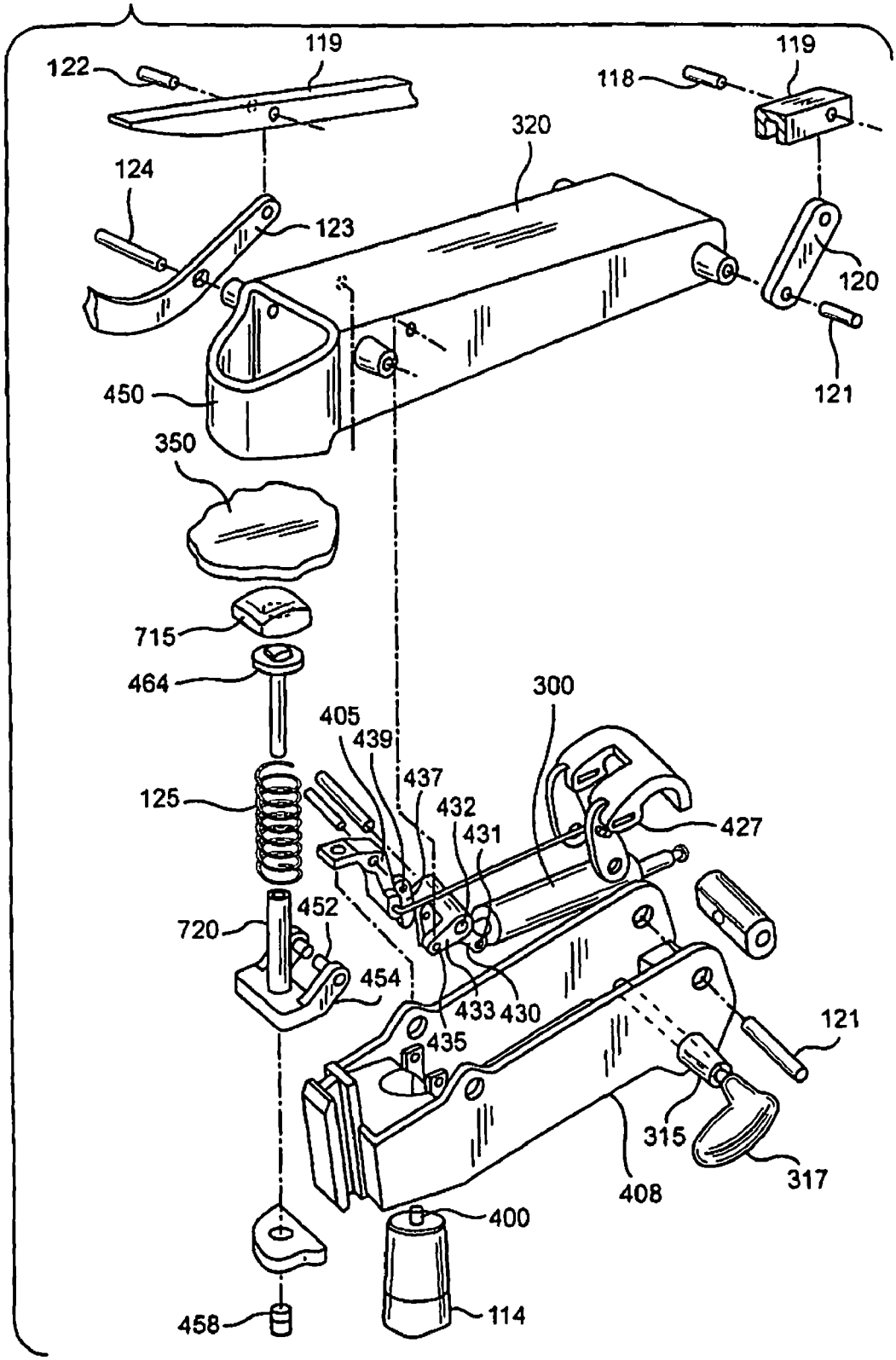
FIG. 8A is an exploded side elevation view of the chair base of FIG. 8.
Figure 10:
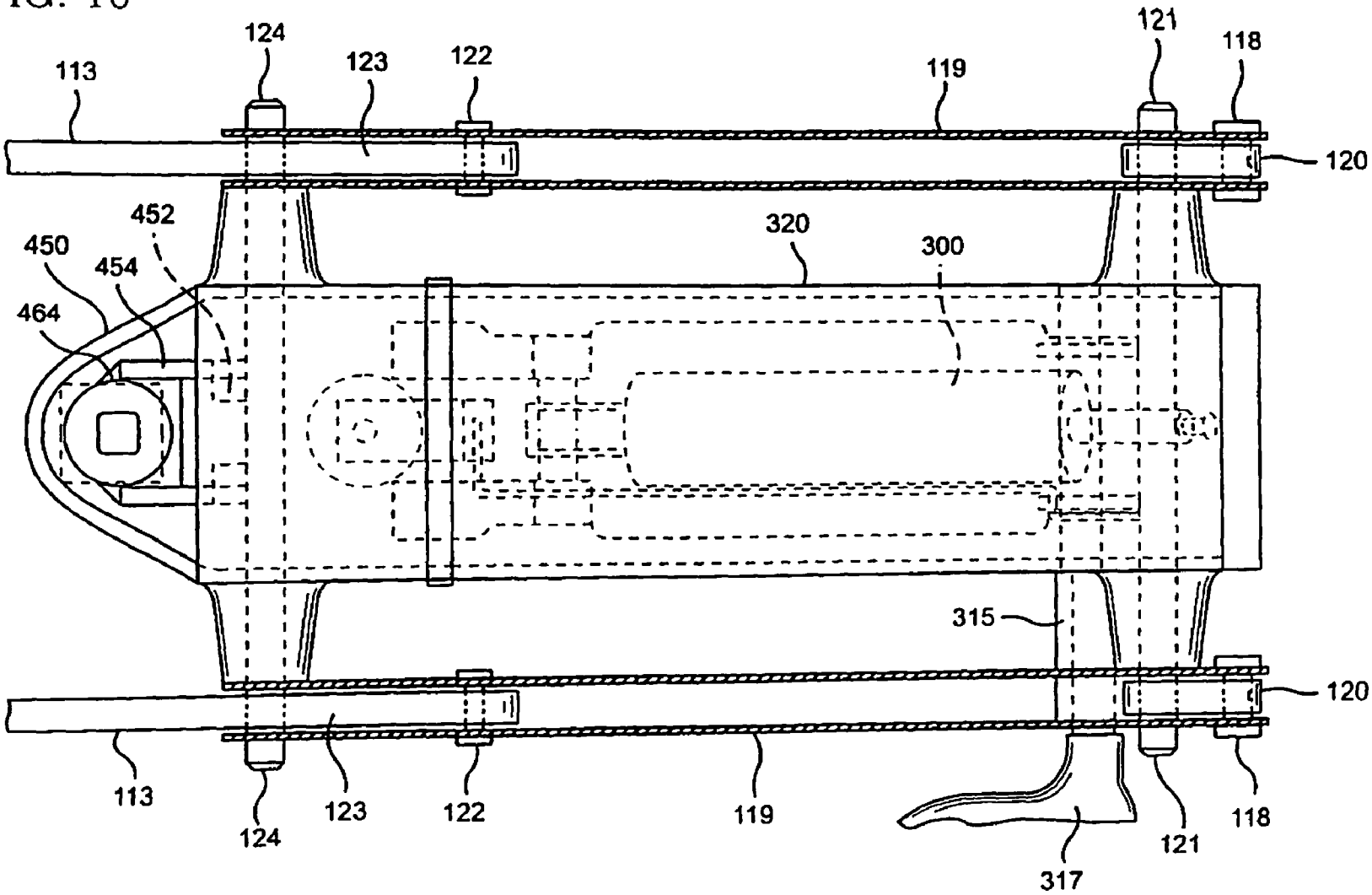
FIG. 10 shows a top view of an embodiment of a chair base of the present invention.

In an alternative, preferred embodiment of the present invention, for purposes of tilting seat 111 and back 112, base 110 has a somewhat inclined, two-part housing. For instance, as shown in FIGS. 8 and 10, top 320 of base 110 houses horizontal pivot points 121 and 124. Also shown in FIG. 10 is housing 315 for a conventional mechanism (such as lever 317) for releasing a first conventional gas cylinder located in pintle 114 that controls the elevation of base 110. This embodiment also has a second conventional gas cylinder, namely gas cylinder 300. Gas cylinder 300 functions to tilt the portions of the chair above base 110 and all parts attached to top 320.

FIG. 8 shows a side view of base 110 in the forward tilted position. In this view, base housing top 320 is substantially horizontal. Base housing top 320 is pivotally connected to base housing bottom 430 at horizontal pivot point 121. Piston 420 of gas cylinder 300, is pivotally connected to linkage 430 at pivot point 431. In turn, linkage 430 is pivotally connected to linkage 433 at pivot point 432, forming a crank, which is connected at pivot point 435 to linkage 437 which is secured to base housing top 320 at pivot point 439. Through this linkage system, gas cylinder 300 applies a force to alter the tilting angle of the chair parts above it.

Also shown in FIG. 8 is a conventional linkage mechanism that operatively connects housing 315 (for lever 317) with a conventional release mechanism 405 for conventional gas cylinder 400 located in pintle 114 that controls the elevation of base 110.

In a preferred embodiment of the mechanism of FIG. 8, the counterclockwise rotation of lever 317 activates conventional release mechanism 405, whereas the clockwise rotation of lever 317 activates gas cylinder 300. Concurrently, the clockwise rotation of lever 317, because of slot 427, permits the mechanism connecting lever 317 to gas cylinder 400 to "float" or slid in slot 427 and thereby not activate conventional release mechanism 405

FIG. 8 further shows the preferred spring mechanism that increases the tilt restoring force as the tilt angle is increased. Specifically, spring 125 is mounted on spring base 460 that is pivotally connected to mount 458 within chamber 456 of spring housing 450. Arm 454 pivotally connects spring housing 450 to lower base housing part 408. Mounted in spring 125 is spring piston 462, the top of which, spring piston top (or telescoping spring guide) 464, pushes against chamber 468 top 466.

It is preferred that chamber 468 top 466 is an arc equidistant from spring base 460 mount 458 to chamber 468 top 466. This arrangement allows spring 125 and piston assembly (or telescoping spring guide) 464 to move varying distances from pivot 124, thereby increasing or reducing leverage force to back support 113.

Figure 9:
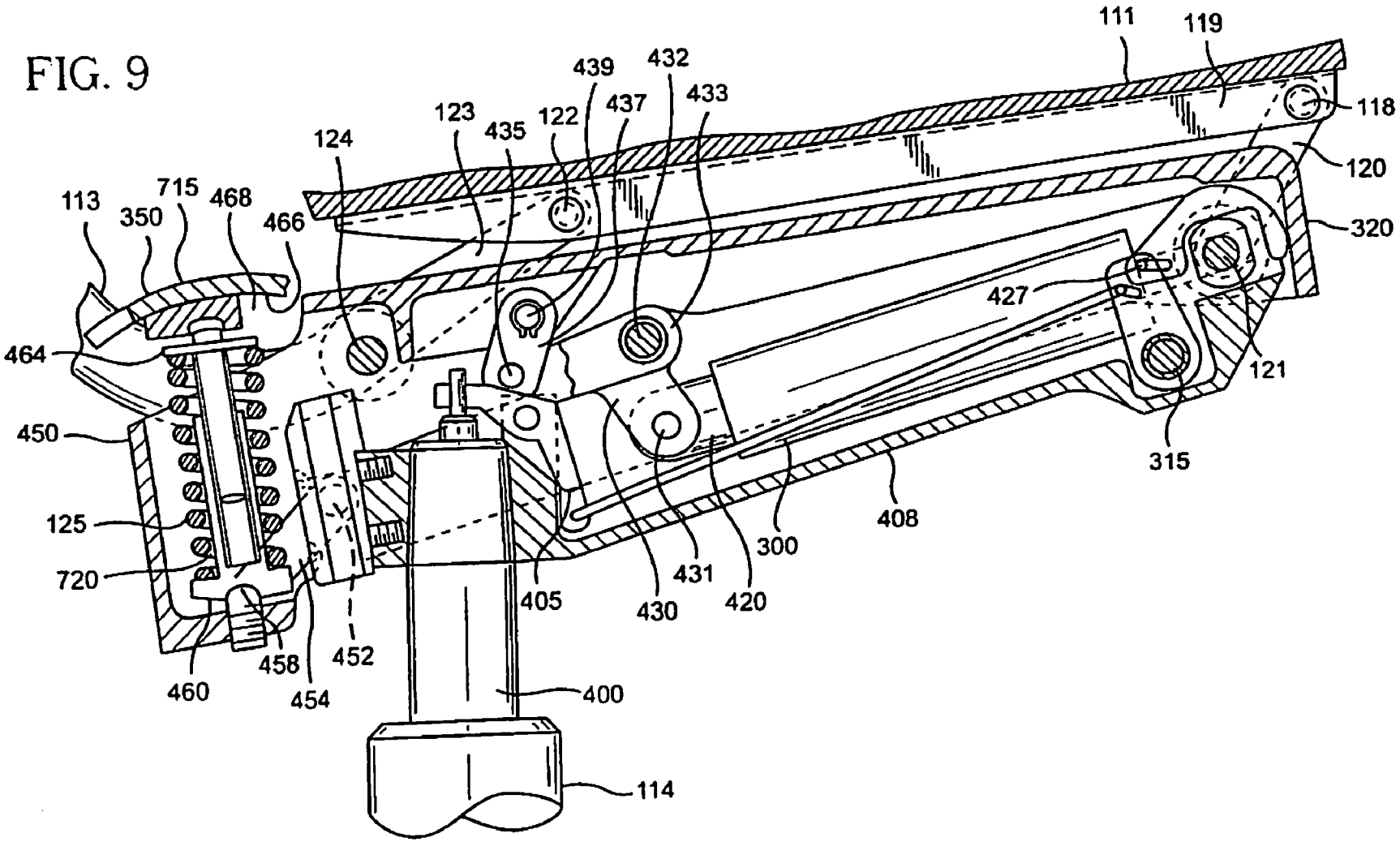
FIG. 9 is a side elevation view of a chair base capable of providing extra tilt to a chair of the present invention in the increased tilt position.

FIG. 9 shows a side view of base 110 in its full rearward tilt position. In this view, base housing top 320 is substantially inclined. In particular, arm 454 and its pivotal connection 452, in this figure, has slid radially along the under-surface of top 466 to its position furthest from the pivot axis at 124. Top 466 has an under-surface which is angled in a curvilinear fashion such that arm 454 connected to spring base 460, spring piston 462 and piston assembly (or telescoping spring guide) 464 is tilted to the rear moving the top of spring 125 further from pivot 124 thereby increasing leverage. The top of telescoping spring guide 464 is pivotally seated in pillow block 715 so that it will slide along the arcuate under-surface of top 466 without changing compression of spring 125. As a result of this repositioning, spring piston top 464 now pushes against chamber 468 top 466 at a point that is further from horizontal pivot point 124. In other words, as the tilt mechanism increases is rearward tilt, the centerline of spring 125 tilts rearwardly at an increased angle relative to a vertical plane. These changes increase the leverage on spring 125 in the rear tilted position, producing a recline compression in spring 125 that increases as the angle of the tilt of spring 125 from the vertical plane increases and decreases as the angle of the tilt of spring 125 from the vertical plane decreases. The net effect is to increase the resistance of spring 125 to any further incremental deformation. This increase in spring 125's resistance to incremental deformation provides greater resistance to support the increased load on the backrest resulting from the occupant being at a greater recline angle with more load of the occupant's upper body transferred to the back rest.

Spring 125's resistance to incremental deformation can be increased as the chair is reclined in other ways. For example, any mechanism that tilts spring 125 away from horizontal pivot point 124 could accomplish this end. In an alternative embodiment, spring 125 is mounted on a pivoting base from which arises a shield. A manually engaged bar pushes against the shield and thereby tilts spring 125. This tilting increases the distance between the top of spring 125 and horizontal pivot point 124, which increases spring 125's resistance to incremental deformation.

Figure 6:
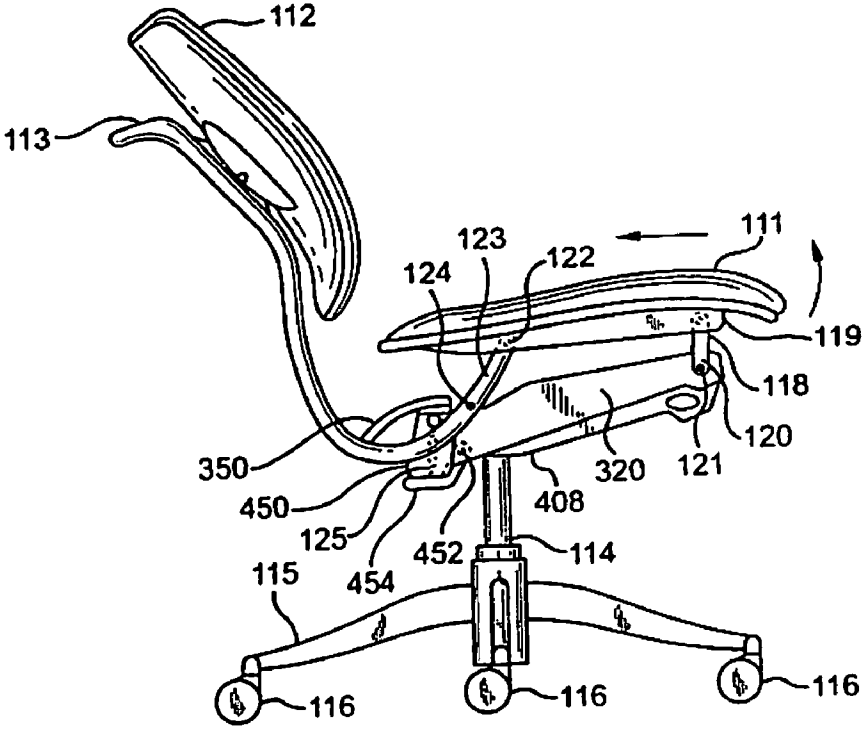
FIG. 6 is a side elevation of a reclining chair having the increased tilt mechanism in accordance with the present invention illustrating the seat and back in tilted position.
Figure 5:
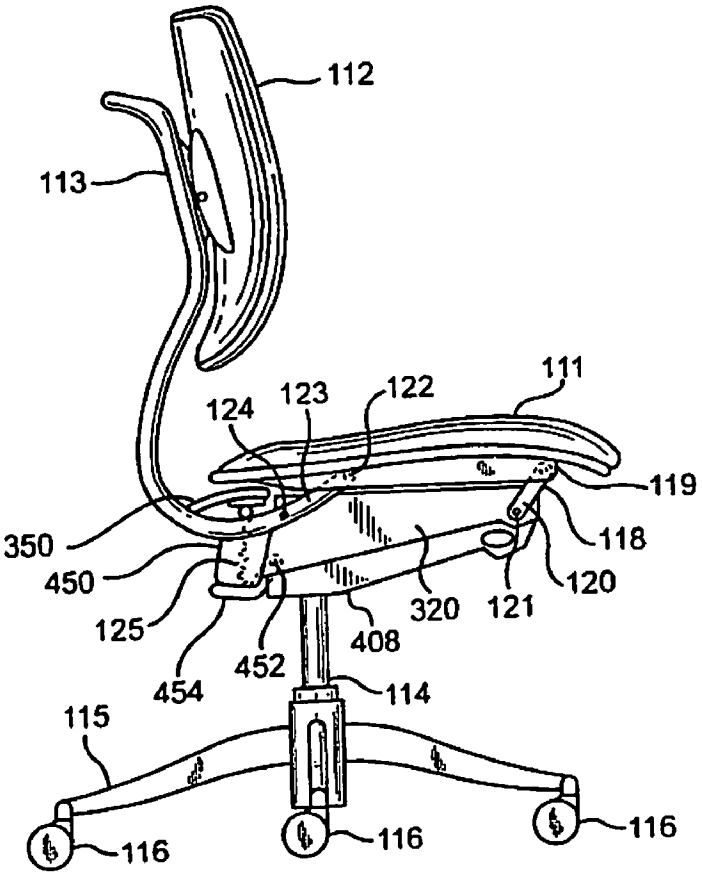
FIG. 5 is a side elevation of a reclining chair having the increased tilt mechanism in accordance with the present invention illustrating the seat and back in upright position.

The functioning of the additional tilt mechanism of the present invention incorporated into a reclining chair is illustrated in FIGS. 5 and 6. FIG. 5 shows the chair in a resting position. Not shown in the FIGS. is a forward tilt position that the additional tilt mechanism is able to achieve. FIG. 6 shows a reclining chair with the additional tilt mechanism in an enhanced tilt position.

More particularly, in FIG. 5, top 320 of base 110 is in a somewhat horizontal position. As top 320 is the fixed link in the four-bar linkage that raises seat 111, when top 320 is horizontal, seat 111 is also largely horizontal. Lower base housing part 408 is pivotally connected to top 320 of base 110 at pivot point 121. When the chair occupant reclines in the chair, the additional tilt mechanism lowers the rear portion of top 320 while the forward portion of top 320 remains in substantially the same position. This movement of top 320 moves 454 about pivot 452, which in turn lowers spring housing 450 and increases the angle between the centerline of spring 125 and a vertical line going through the base of the centerline of spring 125. This movement also increases the distance between pivot point 124 and the point at which spring 350 contacts back support 113.

As noted above, this rotation of spring 125 increases the distance of the center of spring pressure which in turn increases the force urging the chair back into its resting position. However, this spring force requires the additional force provided by the occupant's weight to return the chair to the upright position when the chair occupant reclines.

Desirably, the additional tilt mechanism adds up to between about 1° and 15° of a forward tilt (i.e., a tilt in which the rear end of the seat rises in relation to the front) and it is more preferred that the additional tilt mechanism adds up to between about 3° and 10° of a forward tilt. It is yet further preferred that the additional tilt mechanism adds up to between about 4° and 8° of forward tilt. In a particularly preferred embodiment, the additional tilt mechanism adds up to about 6° of a forward tilt.

As noted above, the additional tilt mechanism add up to between about 1° and 12° of a rearward tilt (i.e., a tilt in which the rear end of the seat is lowered in relation to the front). It is more preferred that the additional tilt mechanism adds up to between about 2° and 10° of a rearward tilt. It is yet further preferred that the additional tilt mechanism adds up to between about 3° and 7° of rearward tilt. In a particularly preferred embodiment, the additional tilt mechanism adds up to about 5° of a rearward tilt. In adding an additional rearward tilt, caution must be taken to prevent the chair from reclining to a position such that the center of gravity of the occupied chair is moved significantly behind pintle 114 to prevent the chair from tumbling over backwards.

Figure 4:
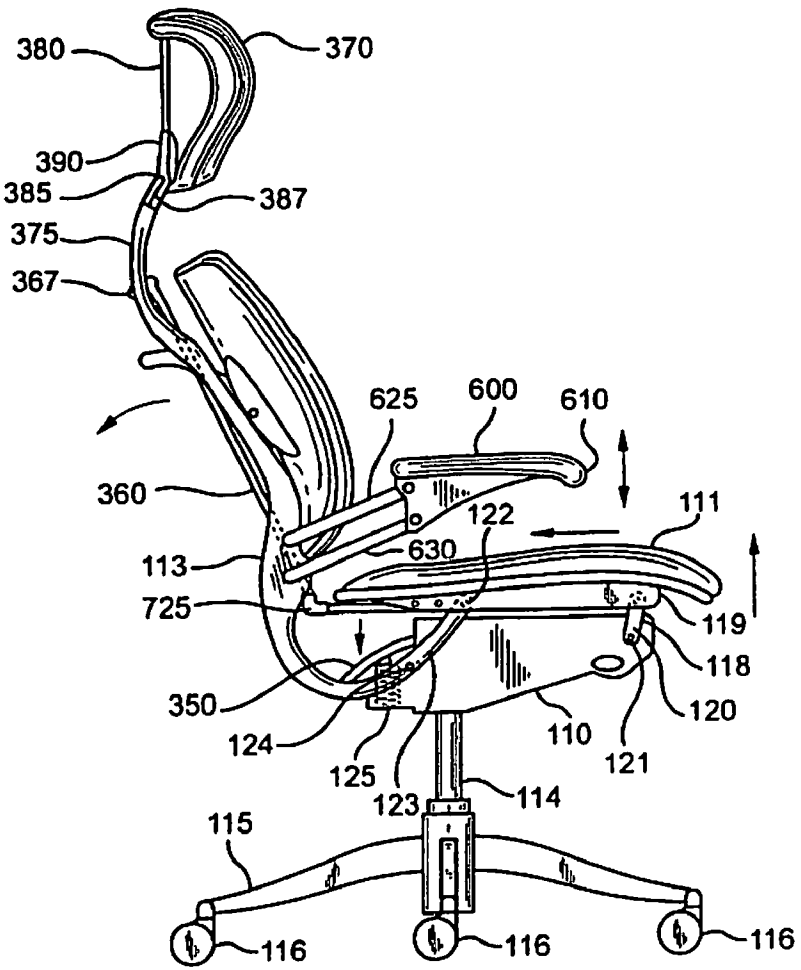
FIG. 4 is a side elevation of a reclining chair having the automatically adjusting headrest and adjustable armrests in accordance with the present invention illustrating the seat and back in tilted position.
Figure 3:
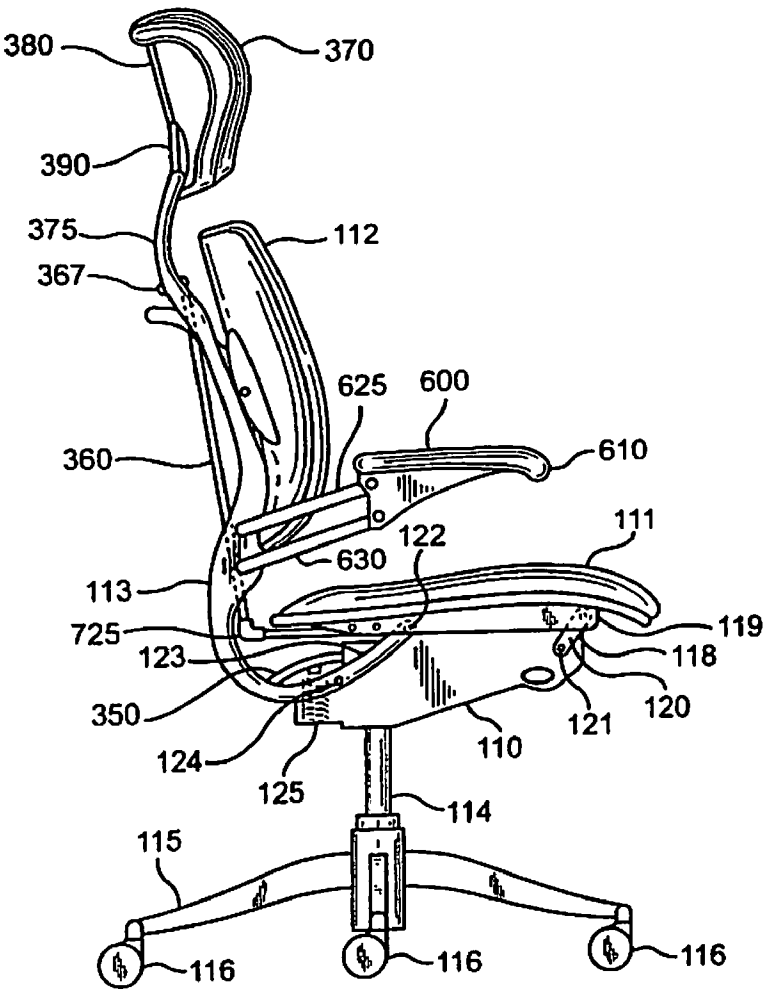
FIG. 3 is a side elevation of a reclining chair having the automatically adjusting headrest and adjustable armrests in accordance with the present invention illustrating the seat and back in upright position.

In a further aspect of the present invention, the chair is provided with a headrest that is urged forward as the back of the chair is tilted. The more the chair is tilted, the more the headrest moves forward. A preferred embodiment of this automatic headrest adjustment mechanism in a chair that incorporates both the reclining back that is opposed by the weight of the user and the automatically adjusting headrest developments of the present invention is illustrated by FIGS. 3 and 4.

Specifically, in addition to the several elements discussed in connection with the reclining mechanism of the chair of FIG. 1, this embodiment also includes automatically adjusting headrest 370.

Mounted to the back of headrest 370 (also illustrated in an enlarged form in FIG. 20) is vertical adjustment bar 380. Typically, there are a pair of parallel vertical adjustment bars 380 mounted to the back of headrest 370. It is preferred that vertical adjustment bars have an adjustment range of between about 2 and 10 inches, and it is more preferred that these bars have an adjustment range of between about 3 and 7 inches in length. A particularly preferred range of vertical adjustment bar is about 5 inches.

Vertical adjustment bar(s) 380 pass through mounting 390. It is preferred that mounting 390 and vertical adjustment bar 380 interact in a manner that retains the position of the headrest 370 relative to mounting 390. For example, vertical adjustment bar 380 might be maintained in position within mounting 390 by a conventional frictional engagement. Alternatively, vertical adjustment bar 380 might have a plurality of apertures through which a mounting bar might pass to anchor vertical adjustment bar 380 within mounting 390. A further alternative might consist of a conventional ratchet mechanism or substantially any other conventional means for fixing the position of a bar within a mounting.

Mounting 390 is affixed to a carriage 385. Carriage 385 travels along a track on the interior side of back support extension 375. Back support extension 375, and correspondingly the track along the interior side of back support 375, is curved. The curve of back support extension 375 (and hence of the interior track) corresponds to the arc through which a user's head travels when it the head is tilted back and forth when the user is seated. Desirably, this arc has a centerpoint corresponding to an imaginary axis through the shoulder joint of the user and a radius corresponding to the distance from this centerpoint to the bottom of the user's ear.

At carriage connection 365, carriage 385 is pivotally connected to rod 360 at point 367. Rod 360 is at its lower end, pivotally connected to seat support extension 725 at point 357, which in turn is connected to seat support 119. As the length of rod 360 is substantially fixed, the differential in arc between chair back 113 and lower rod pivot 725 combined with the additional lifting action of seat support 119 to which pivot 725 is a part results in an upward push on rod 360 which in turn moves head rest support carriage 385 in its track 375 to cause the desired upward and forward motion. This upward force causes carriage 385 to travel along the track that is on the interior side of back support 375 in an arcuate path. This movement of carriage 385 in turn, moves headrest from its position substantially aligned with back support 113 to a forward position shown in FIG. 4. As a result of this motion, headrest 370 is positioned by the reclining of the chair into the position where it provides the head of the chair user the support needed when the user reclines.

Figure 20:
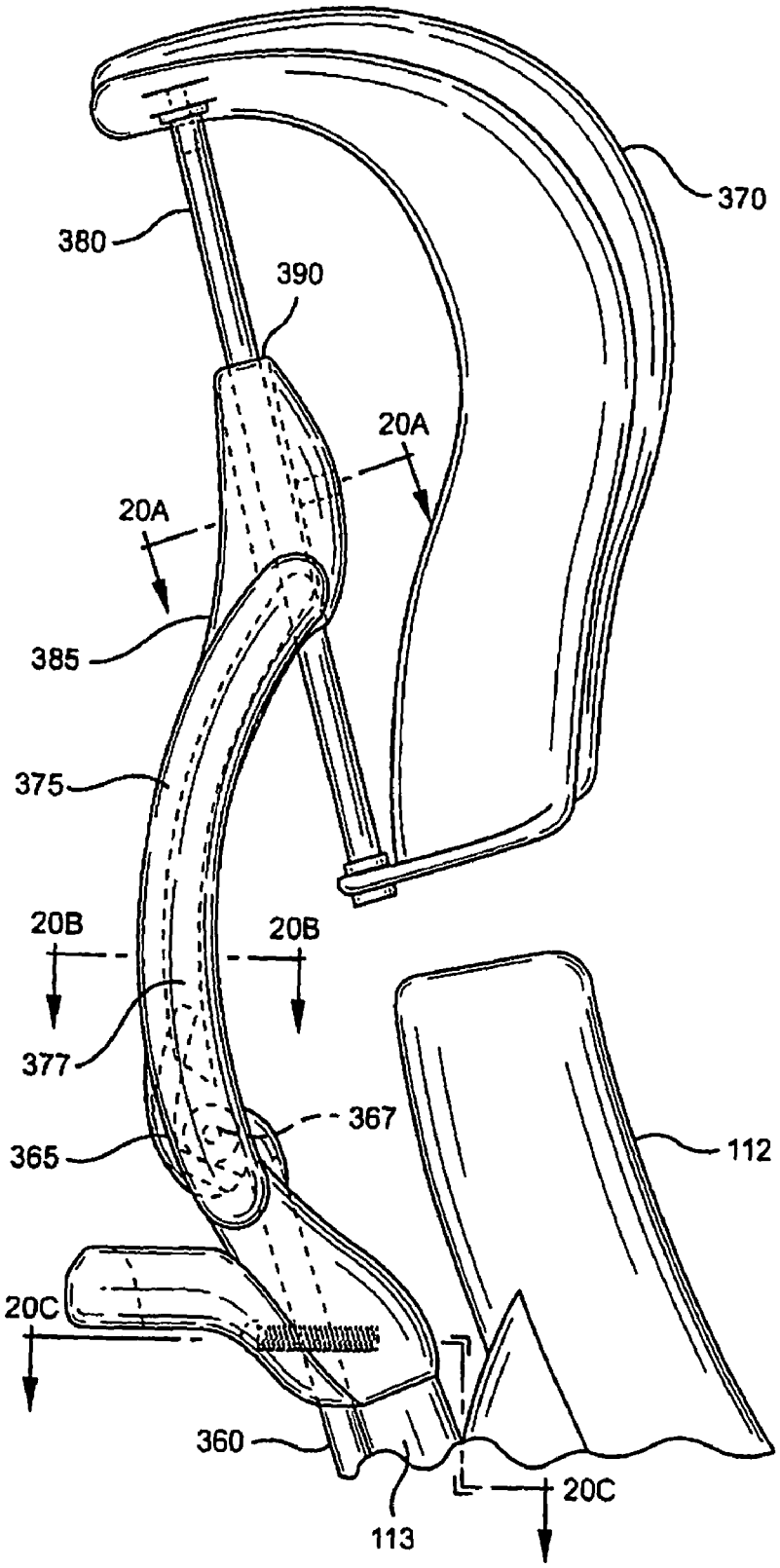
FIG. 20 shows a side view of a headrest mechanism of the present invention.
Figure 20A:
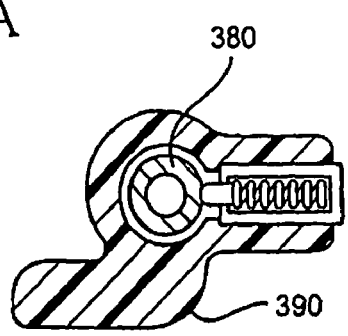
FIG. 20A shows a cut away view of the headrest mechanism of FIG. 20 taken along line 20A-20A.

Cut away view FIG. 20A shows a spring and piston mechanism that can be used to hold vertical adjustment bares) 380 in place in mounting 390.

Figure 20B:
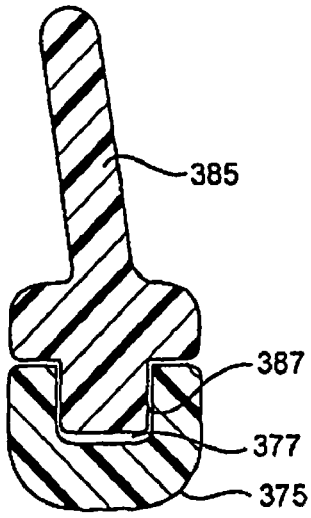
FIG. 20B shows a cut away view of the headrest mechanism of FIG. 20 taken along line 20B-20B.

Cut away view FIG. 20B shows how tongue 387 of carriage 385 fits into track groove 377 of back support extension 375.

Figure 20C:
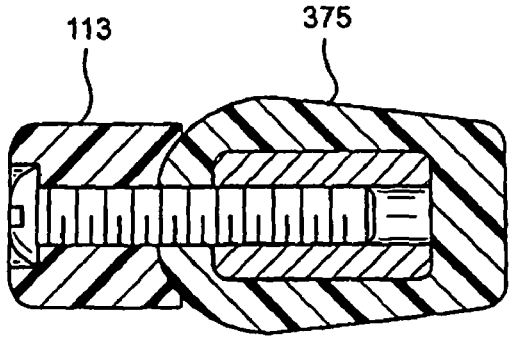
FIG. 20C shows a cut away view of the headrest mechanism of FIG. 20 taken along line 20C-20C.

Cut away view FIG. 20C shows how back support extension 375 is secured to back 113 by a conventional attachment means such as a screw.

Figure 22:
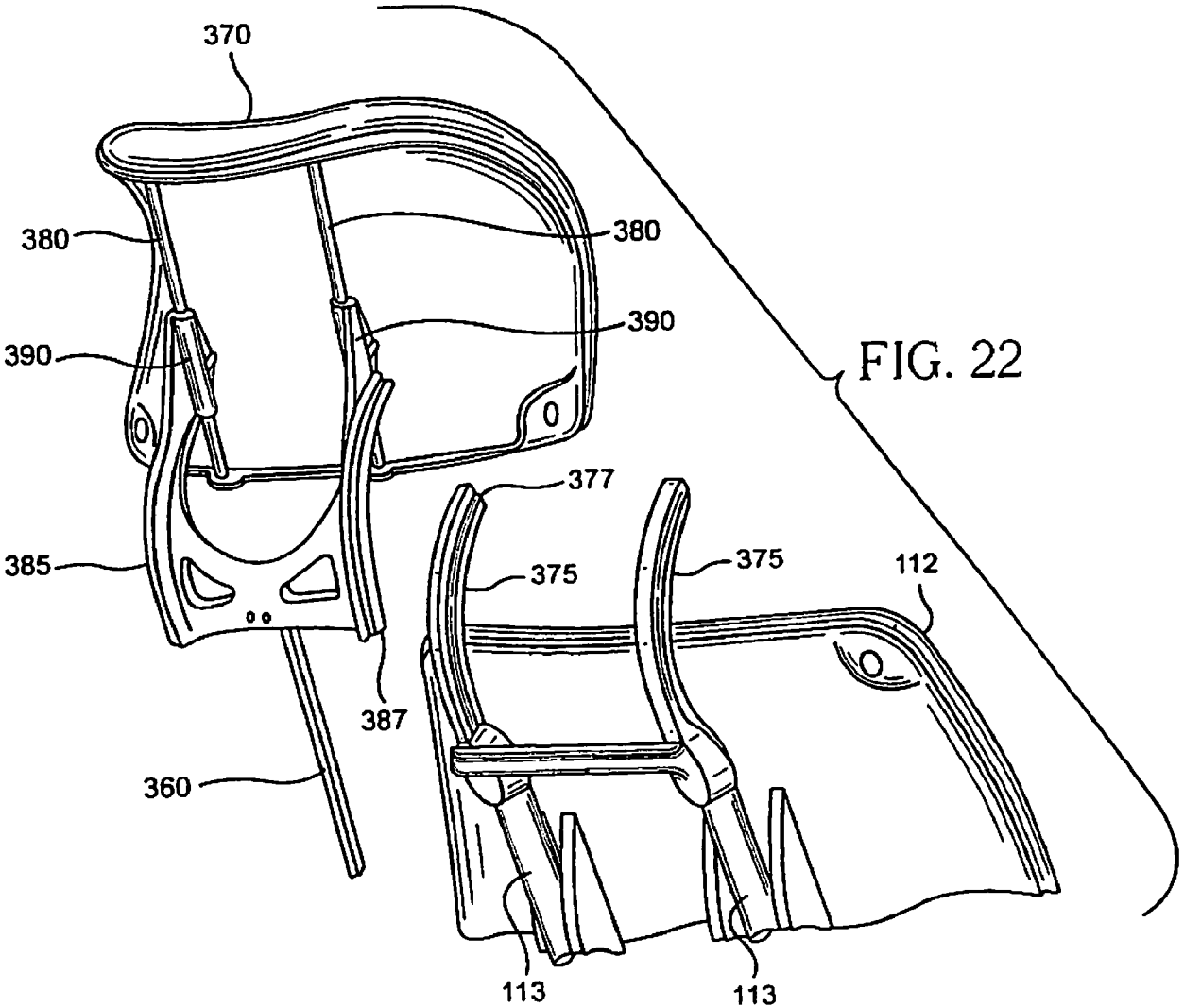
FIG. 22 shows a view of an exploded view of an automatically adjustable headrest.

FIGS. 20 and 22 provide alternative views of an embodiment of an automatically adjusting headrest according to the present invention. Upper and lower interior portions of headrest 370 are connected by vertical adjustment bars 380. Vertical adjustment bars pass through mounting 390 as described above.

Mounting 390 is affixed to the upper portion of carriage 385. Near the lower portion, rod 360 is connected to carriage at point 365.

Carriage 385 travels along a track in back support extension 375 and is propelled by a force applied to carriage 385 by rod 360.

Exploded view FIG. 22 shows an embodiment of the track in back support 375 along which carriage 385 travels. In this embodiment, the track is groove 377 which is in the interior side of each back support 375. Complementarily, carriage 385 has a tongue 387 on each exterior side adapted to fit within grooves 377.

Figure 11:
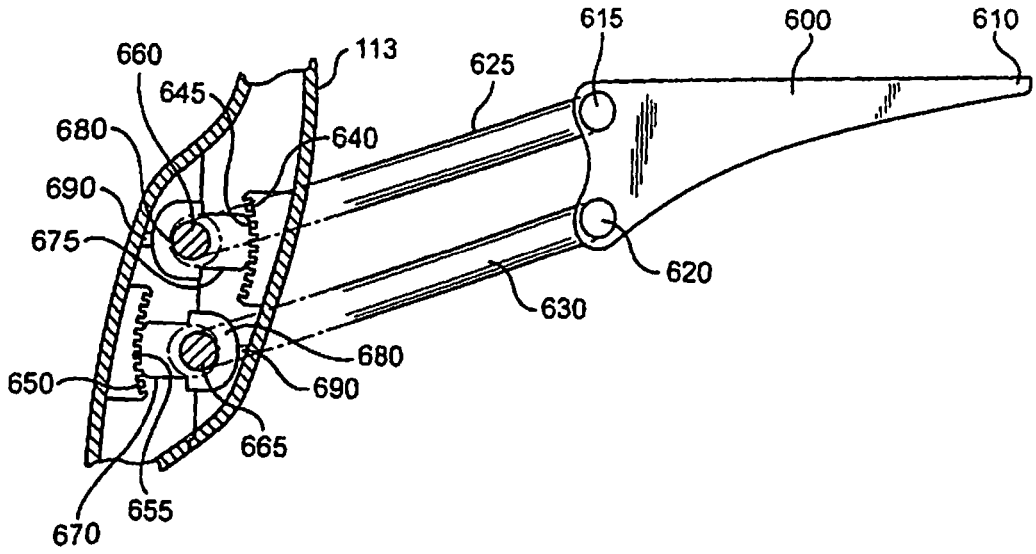
FIG. 11 shows a side view of a preferred armrest including locking mechanism with the locking mechanism engaged.
Figure 12:
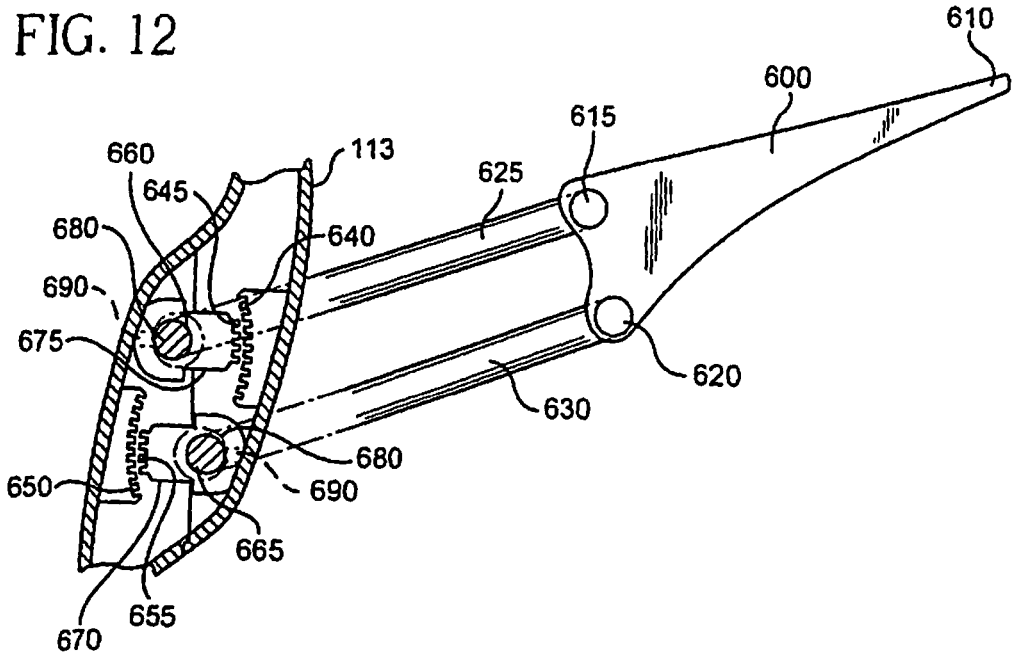
FIG. 12 shows a side view of a preferred armrest including locking mechanism with the locking mechanism disengaged.

Yet another aspect of the present invention is a mechanism for fixing the position of the adjustable arms which can be used in any chair, including the reclining chair of the present invention. FIGS. 11 and 12 illustrate a preferred embodiment of the mechanism for fixing the position of the adjustable arms. In FIG. 11, the mechanism is engaged and the arm is secured in its position. The same mechanism is shown in FIG. 12 where the mechanism is disengaged and the position of the arm can be readily changed.

More particularly, FIG. 11 shows armrest 600 in an in use (and locked) position. Armrest 600 is attached by a pair of pivot joints 615 and 620 to corresponding substantially parallel bars 625 and 630. These bars 625 and 630 are connected to back 113. In this embodiment, back 113 has at least two ratchet surfaces 640 and 650 located on opposite sides of the interior of back 113. Secured to bar 625 by a connecting device 660 is locking bar 675 which has a ratchet face that is complementary to ratchet tooth 640. Similarly, secured to bar 630 by a connecting device 665 is locking bar 670 which has a ratchet face that is complementary to ratchet tooth 650.

When terminal end 610 of armrest 600 is gently raised, as shown in FIG. 12, bar 625 is pushed backward while concurrently bar 630 is pulled forward. This movement of bars 625 and 630 correspondingly cause complementary ratchet face 645 to disengage from ratchet tooth 640 and complementary ratchet face 655 to disengage from ratchet tooth 650. In this disengaged condition, the armrests can be repositioned with very little effort.

To assist the engagement of the ratchet faces with the complementary ratchet teeth, the reverse side of the locking bars (670 and 675) can have a chamber into which a spring 34 can push against a piston 690 that in turn pushes against an interior wall of a chamber inside back support arms 113 to drive the ratchet teeth into the complementary ratchet faces.

Typically, the armrests are attached to the back of the chair about 6 to 12 inches above the rear portion of the seat.

Commonly when a chair has two armrests that are coupled together, the two armrests are linked by a pair of substantially "c" shaped rods. The locking mechanism interacts with these substantially "c" shaped rods at the points where the rods pass through the support for the chair's back, or a housing for this purpose mounted on the back of the chair. When the arms are not interconnected, the shape of the rods may be approximately quarter circle shaped. However, these shapes are general characterizations, any shape can be used provided the shape is effective to (i) position the two armrests substantially parallel to the sides of the seat (if the armrests incorporate the horizontal adjustment development of the present invention, then the armrests should be substantially parallel to the sides of the seat when the armrests are in a centered position) and (ii) not interfere with the user sitting back in the chair.

U.S. Pat. No. 5,292,097 to Russell discloses a variety of alternative locking mechanisms that can readily be adapted for use in support of the armrest of the present invention. This patent is hereby incorporated by reference.

Figure 13:
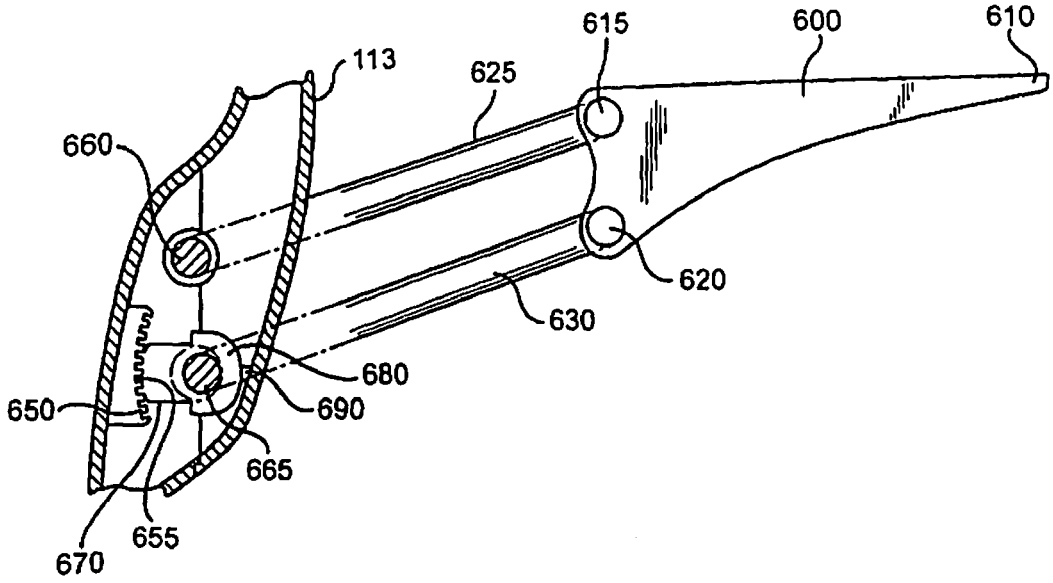
FIG. 13 shows a side view of an alternative armrest locking mechanism with the locking mechanism engaged.
Figure 14:
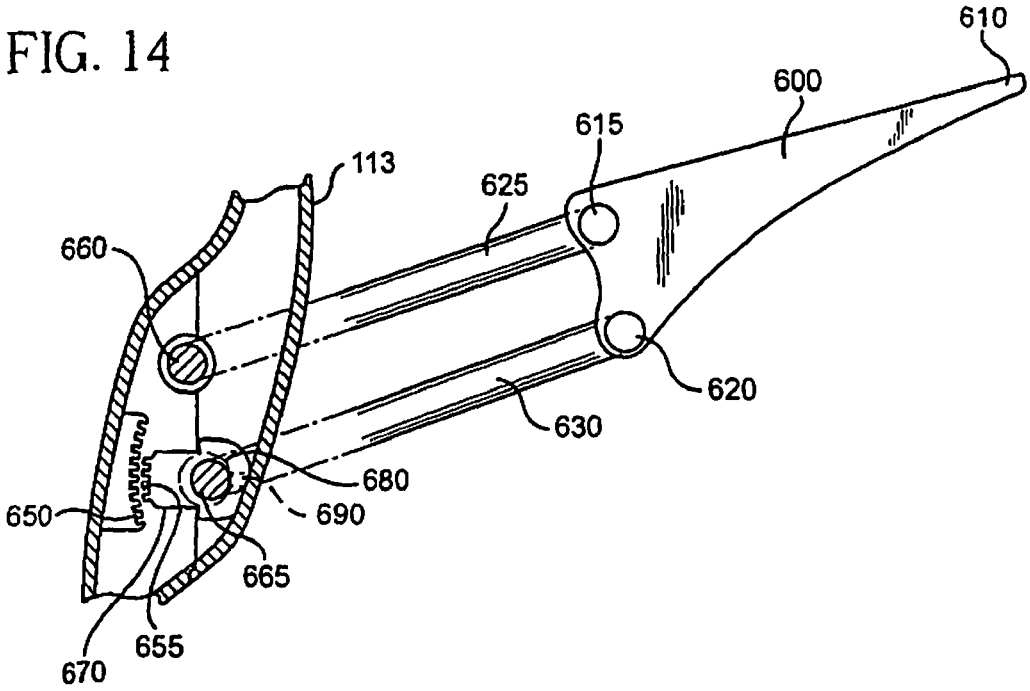
FIG. 14 shows a side view of an alternative armrest locking mechanism with the locking mechanism disengaged.
Figure 15:
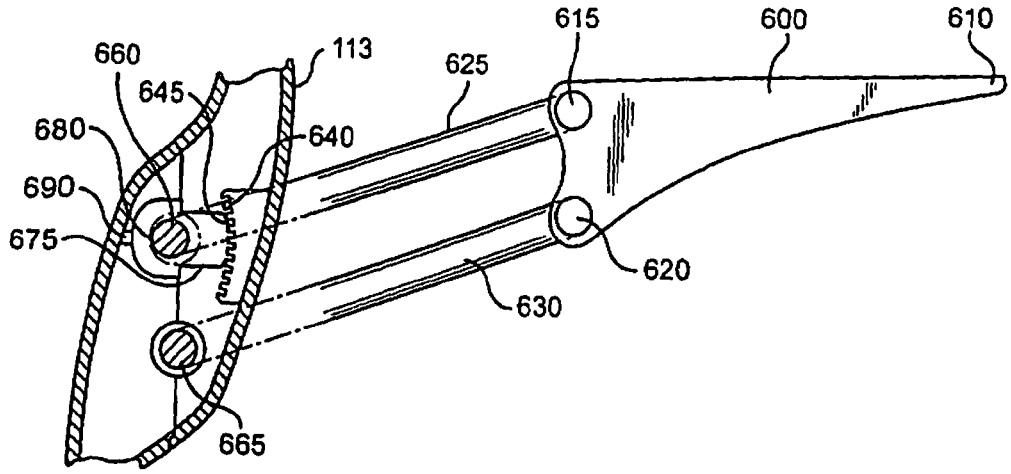
FIG. 15 shows a side view of a further alternative armrest locking mechanism with the locking mechanism engaged.
Figure 16:
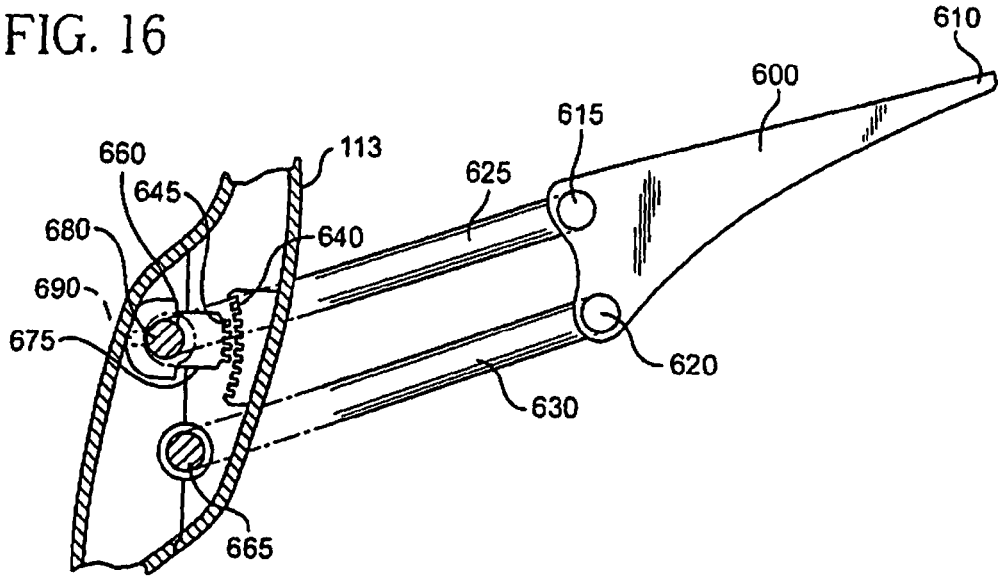
FIG. 16 shows a side view of a further alternative armrest locking mechanism with the locking mechanism disengaged.

FIGS. 13 and 14 illustrate an alternative embodiment of the mechanism for fixing the position of the adjustable arms. In this embodiment, only lower bar 630 has a ratchet face which engages with a ratchet tooth 650. Correspondingly, FIGS. 15 and 16 illustrate a further embodiment of the mechanism for fixing the position of the adjustable arms in which only upper bar 625 is connected to a ratchet face 645 that engages a ratchet tooth 640.

In a preferred embodiment of the mechanism for fixing the position of the adjustable arms, for a chair having a left and a right arm, the two arms are interconnected so that the adjustment of one arm adjusts the other. In such an embodiment, a preferred configuration is one in which only upper bar 625 on one arm, e.g., the right arm, has a ratchet face 645 and a corresponding ratchet tooth 640 and on the other are, the left arm in this example, only the lower bar 630 has a ratchet face 655 and a ratchet tooth 650. In such embodiments, there are two ratchet mechanisms (one on an upper bar and one on a lower bar) between the two arms that cooperate to control the positioning of the arms.

Figure 17:
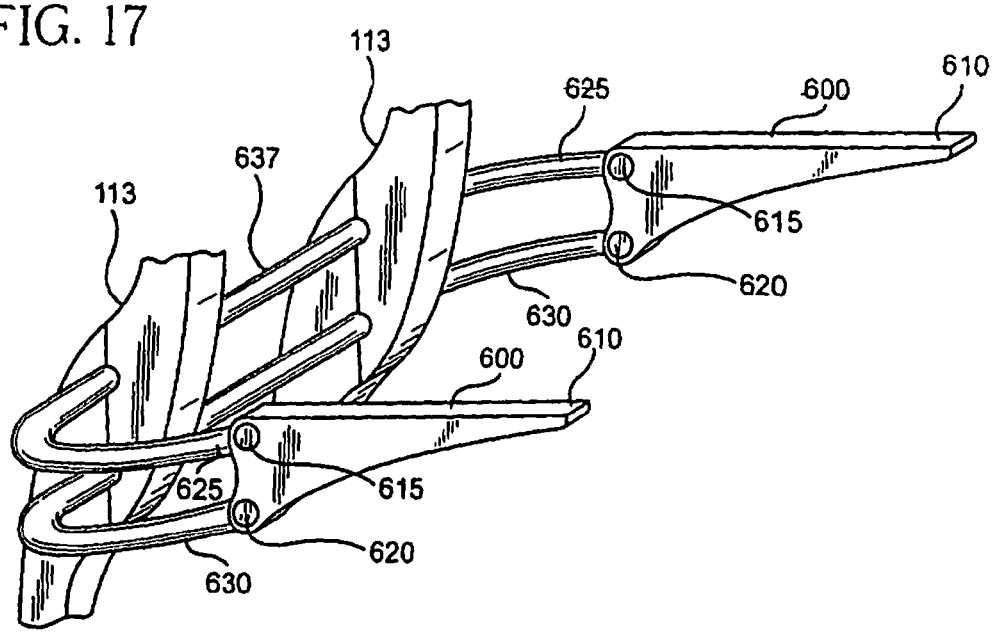
FIG. 17 shows an isometric side view of two interconnected armrest mechanisms.

FIG. 17 provides an isometric view of a pair of armrests in which the upper and the lower bars are interconnected. Specifically, armrests 600 are supported by upper bars 625 and lower bars 630. Within back supports 113, the upper bars 625 and lower bars 630 engage and disengage with the positioning mechanisms. Upper bars 625 are interconnected by connecting bar 637 and lower bars 630 are interconnected by connecting bar 633.

Figure 18:
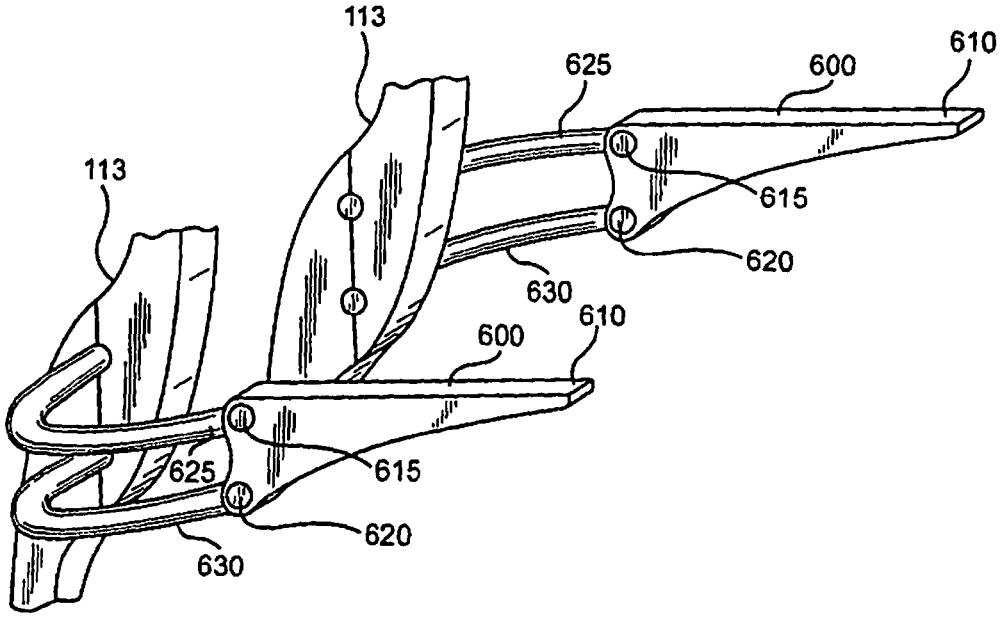
FIG. 18 shows an isometric side view of two isolated armrest mechanisms.

FIG. 18 provides an isometric view of a pair of armrests in which the upper and lower bars are independent. In this embodiment, the repositioning of one arm does not effect the position of the other.

Figure 19:
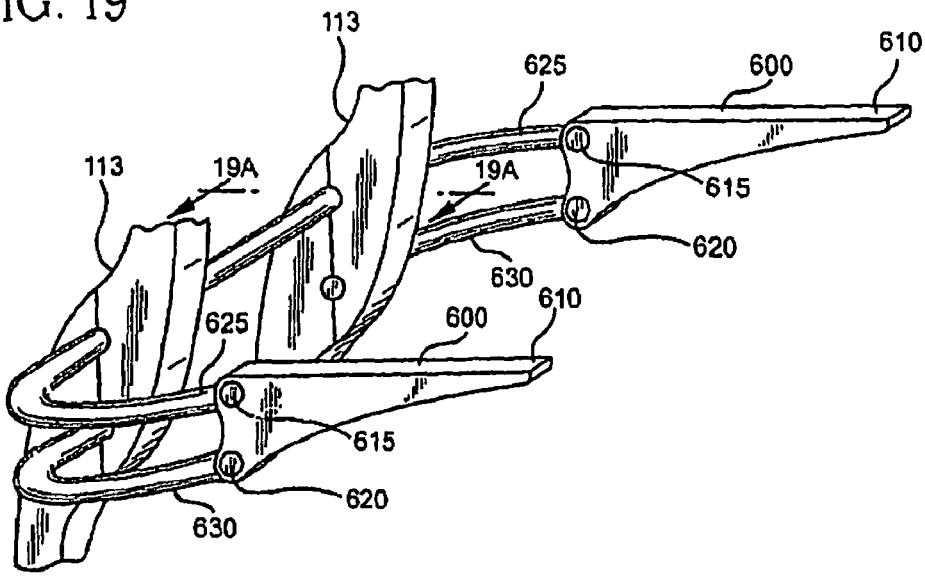
FIG. 19 shows an isometric sideview of two armrest mechanisms interconnected via the top support arm.
Figure 19A:
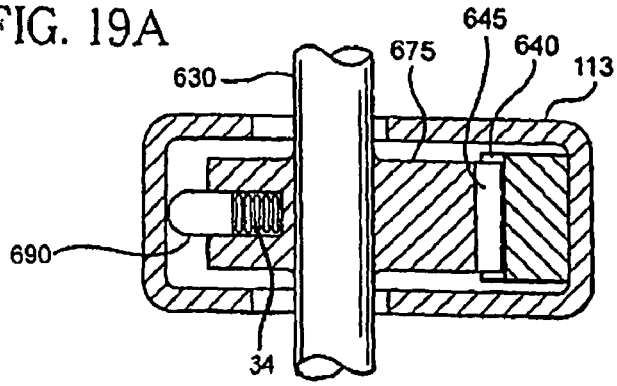
FIG. 19A is a cutaway view along line 19A-19A showing the armrest locking mechanism.
Figure 19B:
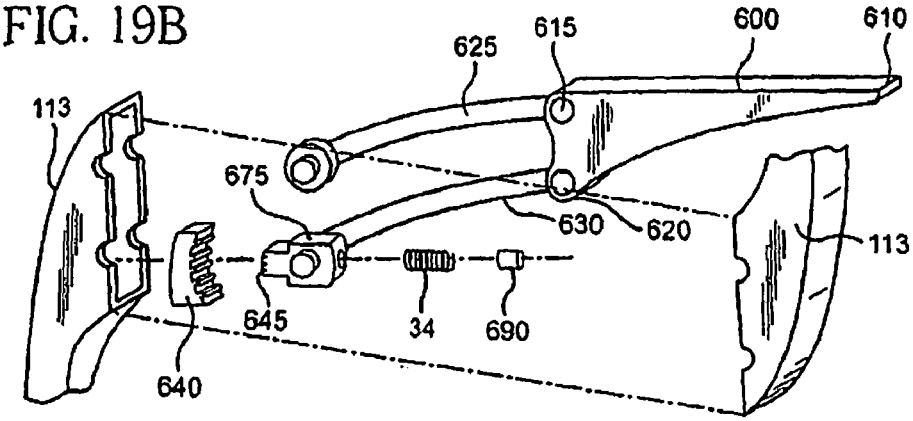
FIG. 19B shows an exploded view of an armrest locking mechanism.

FIG. 19 provides an isometric view of a pair of armrests in which upper bars 625 are interconnected. In this embodiment, the repositioning of one arm is translated into the repositioning of the other arm by means of connecting bar 637.

In an alternative embodiment, connecting bar 637 may include a conventional means to connect and disconnect the bar, such as a sliding bar or a set screw. In such an embodiment, the user can choose to have the adjustment of one armrest adjust the other when the connecting bar is used or the adjustment of one armrest becomes independent of the other when the connecting bar is disengaged.

Figure 23:
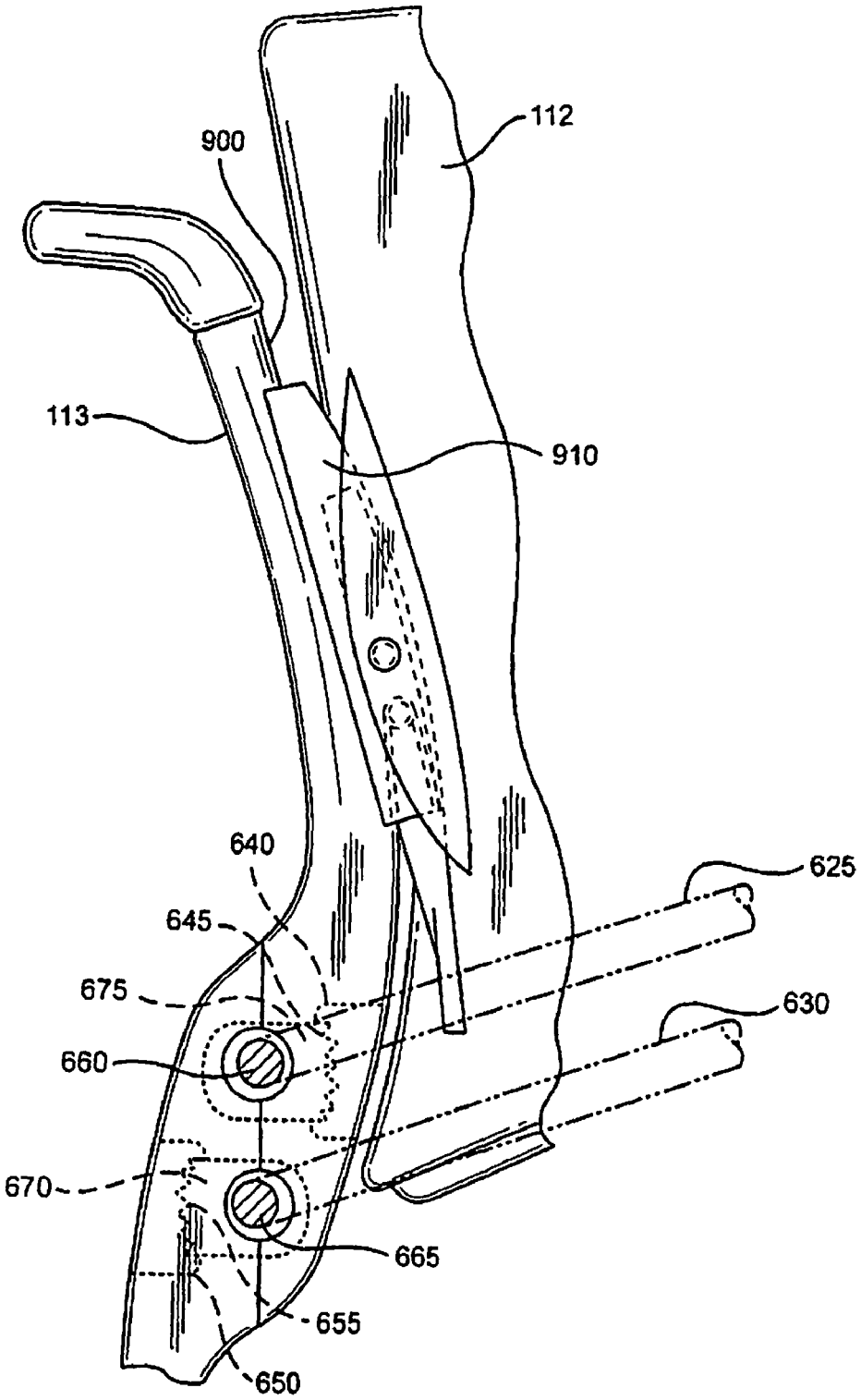
FIG. 23 is a side cutaway view showing an embodiment of a supplemental backrest adjustment mechanism.

FIG. 23 shows yet a still further aspect of the present invention that can be incorporated into the reclining chair of the present invention or any other chair having a back support 113 and a separate seat back 112. In this embodiment, a track 900 mounted on the forward side of back support 113. Seat back 112 has a pair of carriages adapted to travel on these tracks 900. In addition, either track 900 or carriage 910 has a conventional locking mechanism for fixing the position of carriage 910 on track 900.

Useful conventional locking mechanisms include ratchet mechanisms, levers that cause the carriage 910 to clamp onto track 900, screw mechanisms, and mechanisms in which a pin is inserted to fix the carriage position.

Figure 23A:
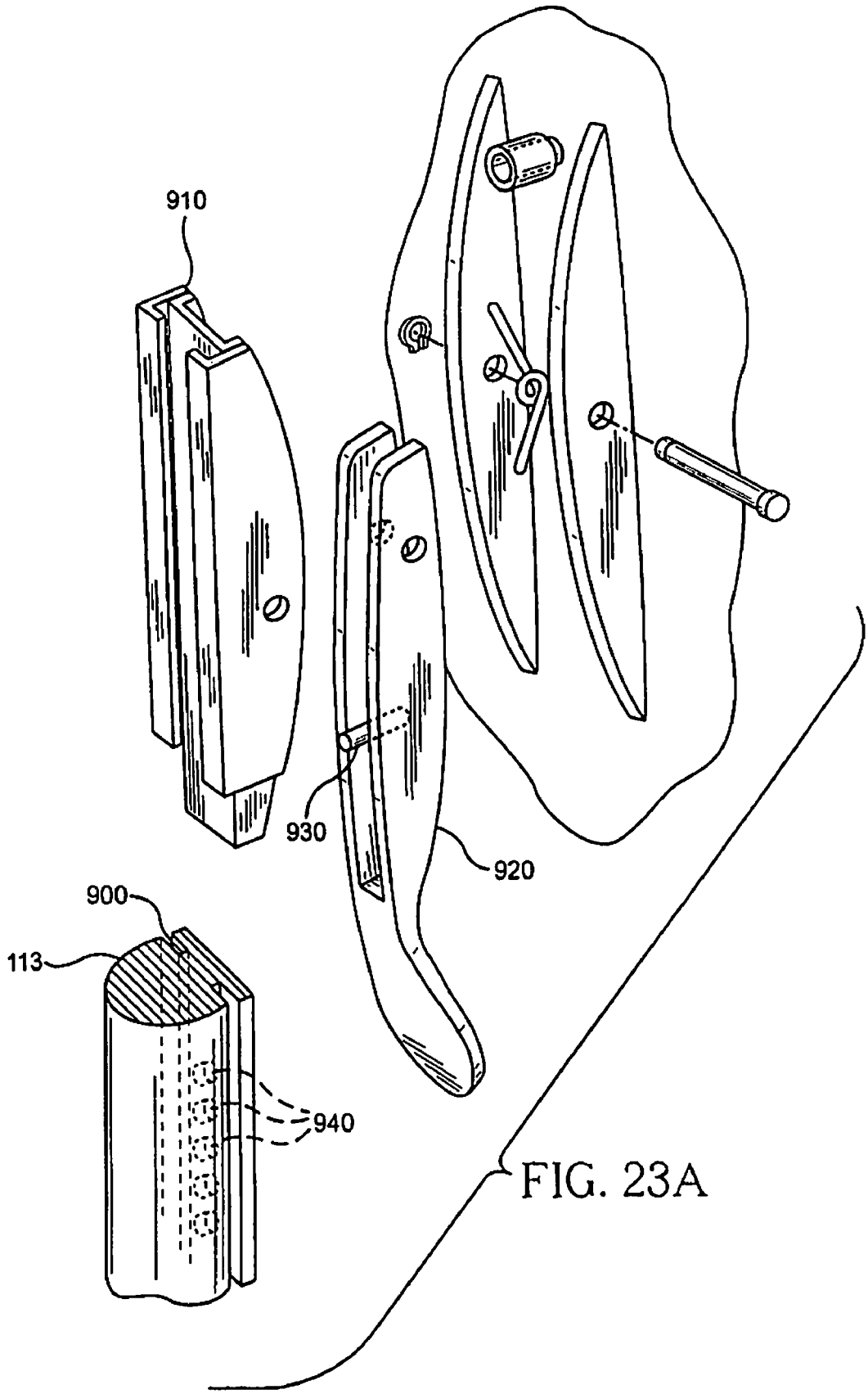
FIG. 23A is an exploded view of the embodiment of FIG. 23.

In a particularly preferred embodiment of the track 900 and carriage 910 mechanism, carriage 910 also has a conventional pivot mechanism that permits seat back 112 to rotate somewhat about this pivot and provide a further adjustment to better support the chair occupant. Such an embodiment is illustrated in FIG. 23A. To fix carriage 910 into the appropriate position, lever 920 is attached to carriage 910. Mounted on lever 920 is pin 930 which when engaged fits into one of a plurality of slots 940. Conversely, when lever 920 is pulled and pin 930 is withdrawn from slot 940, carriage 910 can be moved up or down along track 900 and then when lever 920 is returned to its engagement position, pin 930 enters a new slot 940 and secures seat back 112 into position. A spring can be employed to urge lever 920 into engagement.

Additionally, seat 111, or alternatively a conventional seat pan located directly under seat 111, can be mounted on a pair of carriages that are adapted to travel along a track mounted on the top of seat supports 119. Desirably such carriages would also have a conventional means for fixing the position of the carriages on the track. Additionally, it is also desirable that such tracks have stops on each end of the track to prevent the carriage from traveling beyond the end of the tracks. By putting seat 111 on such a track mechanism, the user is provided with yet another means of ensuring that the seat conforms the geometry of the user's body, and not vice versa.

Figure 24:
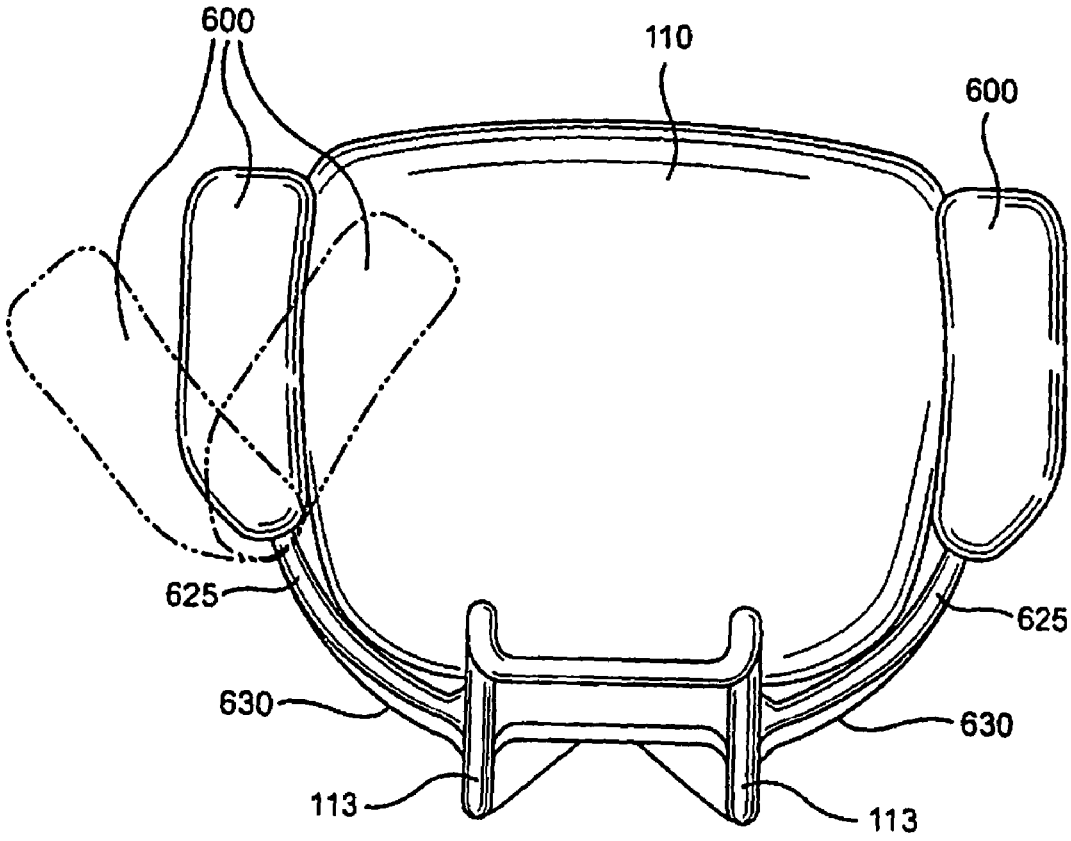
FIG. 24 is a top view of an embodiment of a chair having a pivotable armrest development.

A further development in armrests that can be incorporated into the adjustable armrests of the present invention, or into conventional armrests is a mechanism to permit pivotal horizontal repositioning of the armrests As illustrated in FIGS. 24 through 33. For instance, as shown in FIG. 24, armrest 600 can be pivoted either inward or outward. This additional pivoting of the armrest allows the user to position the armrest under the user's forearm when the user is performing a task such as typing on a keyboard. As a result, the chair provides more support to the user and as a result, it is believed that the user will be less worn as a result of using such support.

Figure 25:
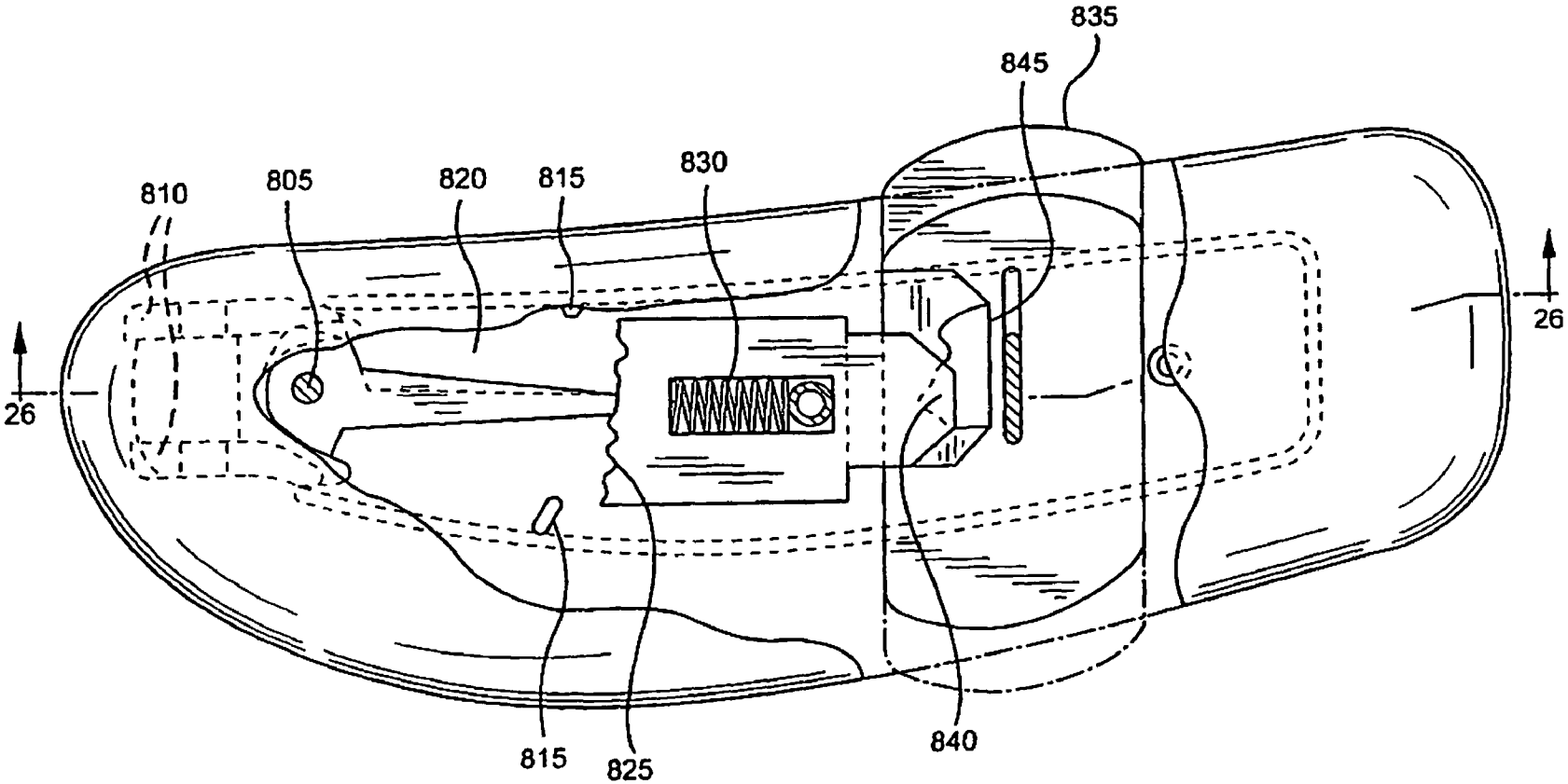
FIG. 25 is a top view of a pivotable armrest with the armrest cushion removed.

Turning now to FIG. 25, a top 800 view of an embodiment of a pivoting armrest taken without the cushioning. Starting at the back of armrest 600, there is clevis base 810 which attaches to bars 625 and 630 to support armrest 600. Within clevis base 810 there is a pivot pin that permits the rotation of armrest 600 about pin 805. However, to restrict the range of rotation available in armrest 600, attached to pivot pin 805 is index arm 820 whose motion is restricted by index arm limiters 815. Additionally, to prevent free pivoting of armrest 600, the armrest also has bar 825 with grooves into which index bar 820 can be secured.

In the embodiment of FIG. 25, bar 825 is locked into place (or permitted to swing freely) by the cooperative action of spring 830, cam follower 840, cam cut-out 845 and sliding lock release control 835. When sliding lock-release control 835 is in the position shown, spring 830 urges bar 825 towards index arm 820 so as to lock pivoting armrest 600 in place. However, when sliding lock-release control is slid into its alternate position, cam follower 840 is positioned in its alternate position in cam cut-out 845, which releases the tension of spring 830 on bar 825 and thereby permitting index arm 820 to be moved into a different groove. If cam follower 840 is left in the detent position, lock bar 825 is disengaged so that armrest 600 can move freely.

In a further preferred embodiment of the pivoting armrest, the distance between adjacent grooves represents about 5° of pivoting. Thus, if there are six grooves, armrest 600 can be pivoted through about 30° of pivoting.

Figure 26:
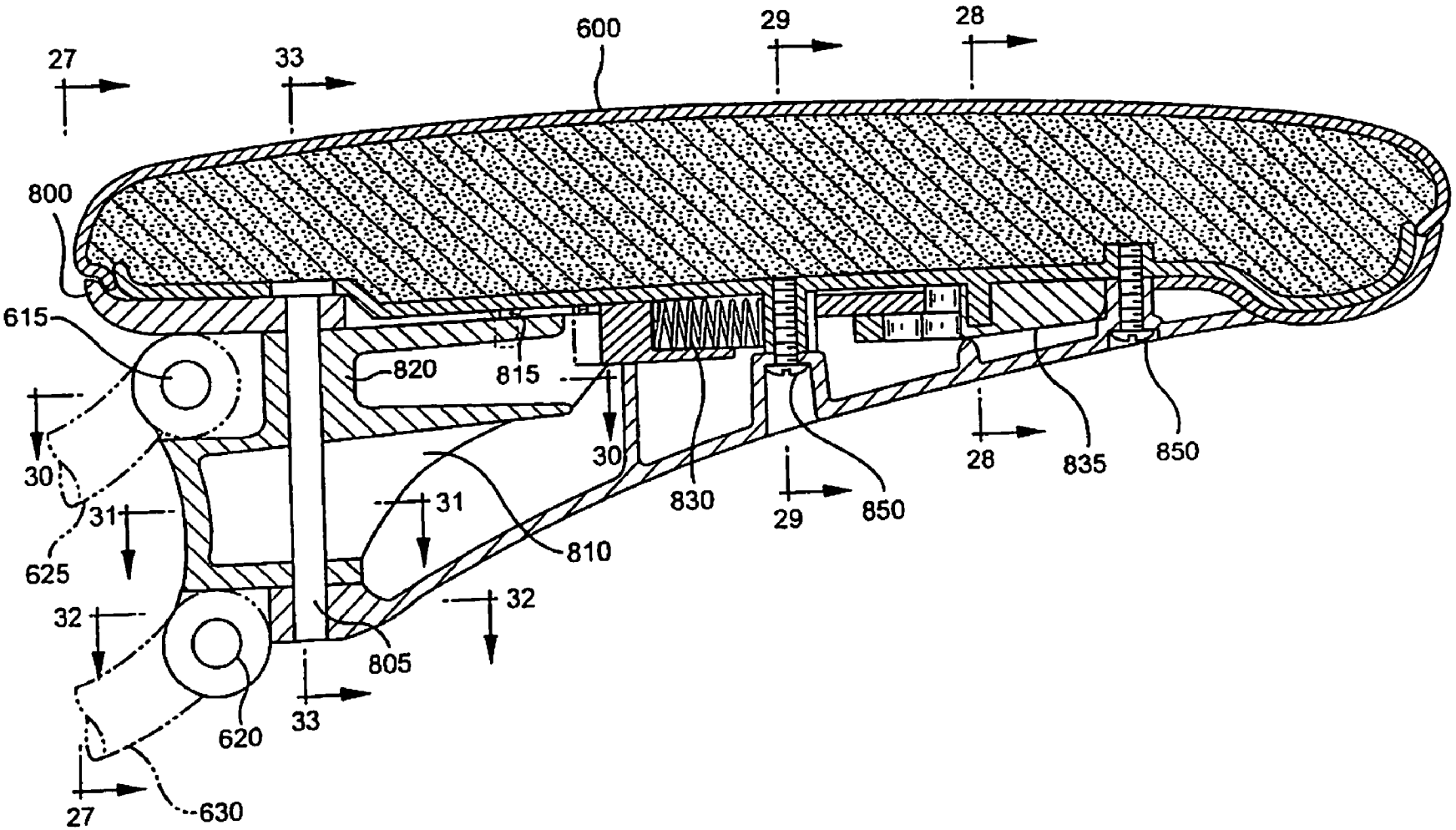
FIG. 26 is a side view of a pivotable armrest.

FIG. 26 shows a side view of a pivoting armrest embodiment. In this view, armrest 600 is attached to bars 625 and 630 by conventional fastening means 615 and 620, respectively. Useful fastening means include nuts and bolts, and clevis pins.

Also in this view clevis base 810 is seen as is pivot pin 805. Additionally, index arm limiter 815 is seen in the plane of index arm 820. Spring 830 urges bar 825 into index arm 820. Sliding lock-release control 835 projects out slightly from armrest 600. Screws 850 attach the cushioning top to the armrest body.

It is particularly preferred that the sliding lock-release control 835 is positioned under the interior tip of the user's thumb on one side and the user's fingers on the other so that the user can readily adjust the pivot position of the armrest.

Figure 27:
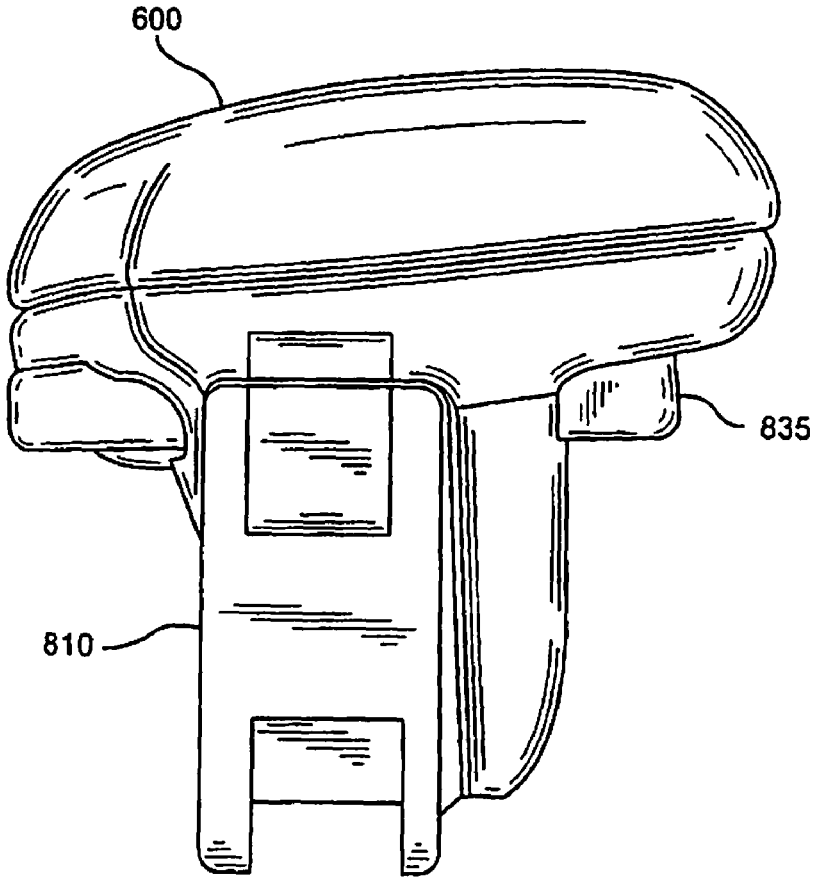
FIG. 27 is a rear view of a pivotable armrest.

FIG. 27 shows a rear view of a pivoting armrest. In this view, clevis base 810 and sliding lock-release controller 835 are apparent.

Figure 28:
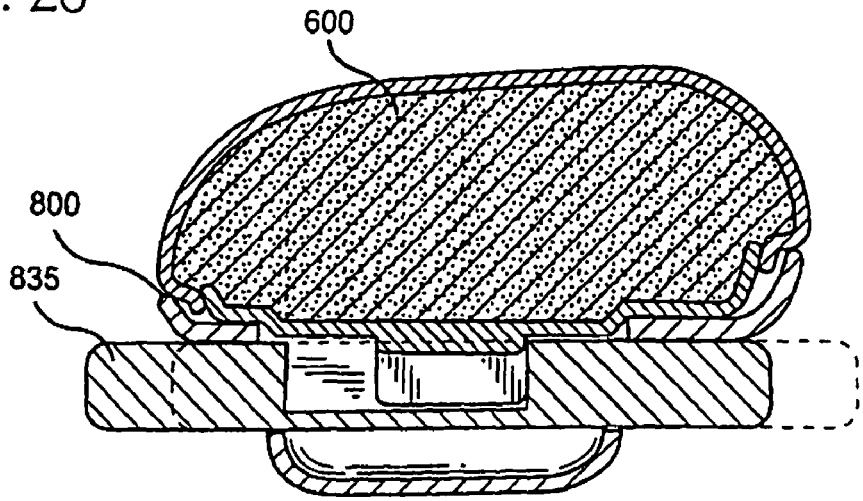
FIG. 28 is a sectional view of a pivotable armrest taken along line 28-28 in FIG. 26.

FIG. 28 shows a sectional view of armrest 600 taken along line 28-28 in FIG. 26. In this view, both the locked and released positions of sliding lock-release control 835 can be seen.

Figure 29:
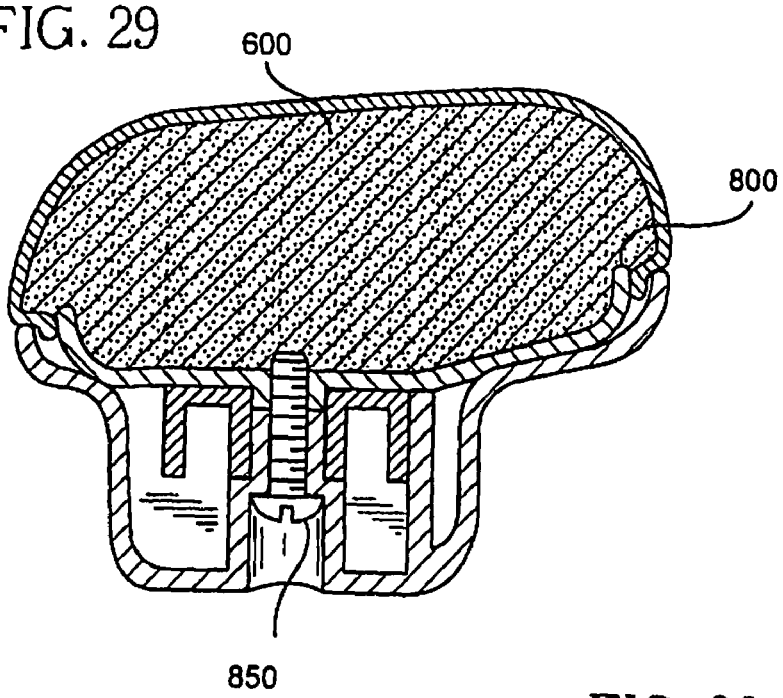
FIG. 29 is a sectional view of a pivotable armrest taken along line 29-29 in FIG. 26.
Figure 30:
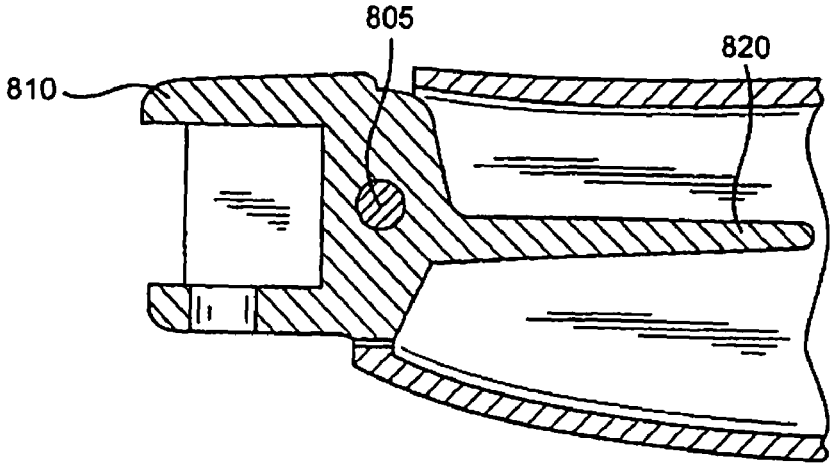
FIG. 30 is a sectional view of a pivotable armrest taken along line 30-30 in FIG. 26.
Figure 31:
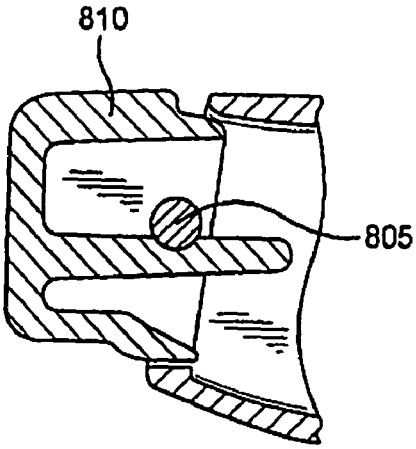
FIG. 31 is a sectional view of a pivotable armrest taken along line 31-31 in FIG. 26.
Figure 32:
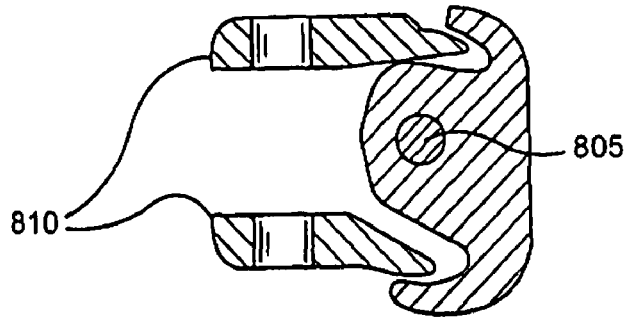
FIG. 32 is a sectional view of a pivotable armrest taken along line 32-32 in FIG. 26.
Figure 33:
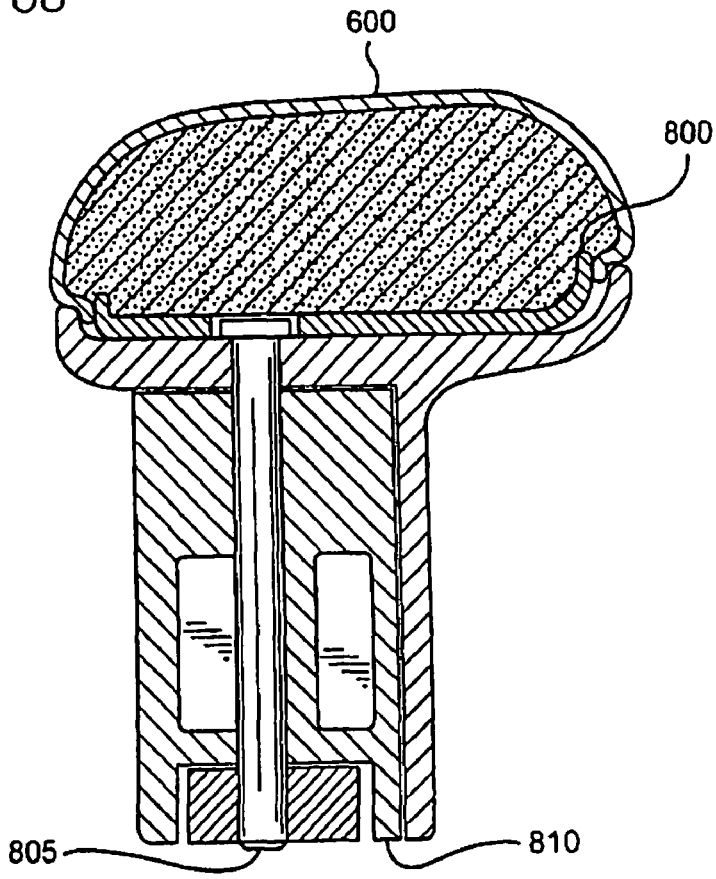
FIG. 33 is a sectional view of a pivotable armrest taken along line 33-33 in FIG. 26.

FIG. 29 shows a sectional view of armrest 600 taken along line 29-29 in FIG. 26. FIG. 30 shows a sectional view of armrest 600 taken along line 30-30 in FIG. 26. FIG. 31 shows a sectional view of armrest 600 taken along line 31-31 in FIG. 26. FIG. 32 shows a sectional view of armrest 600 taken along line 32-32 in FIG. 26. FIG. 33 shows a sectional view of armrest 600 taken along line 33-33 in FIG. 26.

What is claimed is:

1. A chair comprising:

(a) a back support;

(b) an adjustable armrest mechanism, the adjustable armrest mechanism comprising:

i. an armrest comprising a terminal end;

ii. a first parallel bar comprising a first end and a second end, wherein the first end of the first parallel bar is pivotably connected to the armrest, and wherein the second end of the first parallel bar is pivotably connected to the back support;

iii. a second parallel bar comprising a first end and a second end, wherein the first end of the second parallel bar is pivotably connected to the armrest; and iv. a positioning means for releasably connecting the second end of the second parallel bar to the back support, wherein the positioning means disengages when the terminal end of the armrest is raised.

2. The chair of claim 1 further comprising a mechanism to permit pivotal horizontal repositioning of the armrest, the horizontal pivot mechanism comprising:

(a) a clevis base attached to the first ends of the first and second parallel bars;

(b) a pivot pin attaching the armrest to the clevis base, the pivot pin defining a horizontal axis of rotation for the armrest such that the armrest pivots in a horizontal plane about the pin;

(c) an index arm connected to the pin, wherein the index arm engages one or more index arm limiters to restrict the armrest's range of movement in the horizontal plane.

3. The chair of claim 2, wherein the horizontal pivot mechanism further comprises a means for locking and unlocking the armrest against pivoting.

4. The chair of claim 3 wherein the means for locking and unlocking the armrest against pivoting comprises a sliding control within the reach of a user of the chair, and wherein the sliding control moves between a locked and unlocked position, the unlocked position allowing the index arm to move freely within the range of movement, and the locked position securing the index arm against movement.

5. A chair comprising:

(a) a back support;

(b) an adjustable armrest mechanism, the adjustable armrest mechanism comprising:

i. an armrest;

ii. a first parallel bar comprising a first end and a second end, wherein the first end of the first parallel bar is pivotably connected to the armrest, and wherein the second end of the first parallel bar is pivotably connected to the back support;

iii. a second parallel bar comprising a first end and a second end, wherein the first end of the second parallel bar is pivotably connected to the armrest;

iv. a first positioning means for releasably connecting the second end of the first parallel bar to the back support; and v. a second positioning means for releasably connecting the second end of the second parallel bar to the back support.

6. The chair of claim 5, further comprising a mechanism to permit pivotal horizontal repositioning of the armrest, the horizontal pivot mechanism comprising:

(a) a clevis base attached to the first ends of the first and second parallel bars;

(b) a pivot pin attaching the armrest to the clevis base, the pivot pin defining a horizontal axis of rotation for the armrest such that the armrest pivots in a horizontal plane about the pin;

(c) an index arm connected to the pin, wherein the index arm engages one or more index arm limiters to restrict the armrest's range of movement in the horizontal plane.

7. The chair of claim 6, wherein the horizontal pivot mechanism further comprises a means for locking and unlocking the armrest against pivoting.

8. The chair of claim 7, wherein the means for locking and unlocking the armrest against pivoting comprises a sliding control within the reach of a user of the chair, and wherein the sliding control moves between a locked and unlocked position, the unlocked position allowing the index arm to move freely within the range of movement, and the locked position securing the index arm against movement.

9. A chair comprising:

(a) a back support;

(b) an adjustable armrest mechanism, the adjustable armrest mechanism comprising:

i. an armrest;

ii. a first parallel bar comprising a first end and a second end, wherein the first end of the first parallel bar is pivotably connected to the armrest, and wherein the second end of the first parallel bar is pivotably connected to the back support;

iii. a second parallel bar comprising a first end and a second end, wherein the first end of the second parallel bar is pivotably connected to the armrest;

iv. a positioning means for releasably connecting the second end of the second parallel bar to the back support; and v. a mechanism to permit pivotal horizontal repositioning of the armrest, the horizontal pivot mechanism comprising:

1. a clevis base attached to the first ends of the first and second parallel bars;

2. a pivot pin attaching the armrest to the clevis base, the pivot pin defining a horizontal axis of rotation for the armrest such that the armrest pivots in a horizontal plane about the pin; and 3. an index arm connected to the pin, wherein the index arm engages one or more index arm limiters to restrict the armrest's range of movement in the horizontal plane.

* * * * *